US010865520B2

(12) United States Patent
Jaakkola et al.

(10) Patent No.: US 10,865,520 B2
(45) Date of Patent: Dec. 15, 2020

(54) METHOD AND APPARATUS FOR CONTROLLING A FIBER FRACTIONATION SYSTEM

(71) Applicant: INTERNATIONAL PAPER COMPANY, Memphis, TN (US)

(72) Inventors: Jyrki Tapio Jaakkola, Gainesville, GA (US); Antti Heikkinen, Treasure Island, FL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/133,995

(22) Filed: Sep. 18, 2018

(65) Prior Publication Data

US 2019/0085509 A1 Mar. 21, 2019

Related U.S. Application Data

(60) Provisional application No. 62/559,861, filed on Sep. 18, 2017.

(51) Int. Cl.

| | |
|---|---|
| ***D21D 5/06*** | (2006.01) |
| ***D21G 9/00*** | (2006.01) |
| ***D21D 99/00*** | (2006.01) |
| ***B03B 5/56*** | (2006.01) |
| ***B03B 13/00*** | (2006.01) |

(52) U.S. Cl.

CPC ..... *D21D 5/06* (2013.01); *B03B 5/56* (2013.01); *B03B 13/00* (2013.01); *D21D 99/00* (2013.01); *D21G 9/0018* (2013.01)

(58) Field of Classification Search

USPC ..... 162/259

See application file for complete search history.

(56) References Cited

U.S. PATENT DOCUMENTS

| | | | | |
|---|---|---|---|---|
| 3,595,487 | A | | 7/1971 | Bidwell |
| 3,711,688 | A | | 1/1973 | Stout et al. |
| 4,098,642 | A | | 7/1978 | Luthi |
| 4,276,159 | A | | 6/1981 | Lehman |
| 5,405,499 | A | * | 4/1995 | Vinson ..... D21D 5/00 162/100 |
| 5,566,833 | A | | 10/1996 | Pfeffer et al. |
| 5,601,192 | A | | 2/1997 | Hutzler et al. |
| 5,766,448 | A | | 1/1998 | Markham |
| 5,916,417 | A | | 6/1999 | Cassidy et al. |
| 5,960,374 | A | | 9/1999 | Lausier |
| 6,391,153 | B1 | | 5/2002 | Wikdahl |
| 6,413,363 | B1 | | 7/2002 | Hsu |
| 6,517,680 | B1 | | 2/2003 | Fredlund et al. |
| 6,592,712 | B2 | | 7/2003 | Koukoulas et al. |
| 6,631,861 | B1 | | 10/2003 | Kawaguchi |
| 6,846,384 | B2 | | 1/2005 | Jissila et al. |
| 7,077,930 | B2 | | 7/2006 | Ammala et al. |
| 7,360,728 | B2 | | 4/2008 | Rousseau |
| 9,540,769 | B2 | | 1/2017 | Figiel |
| 9,696,226 | B2 | | 7/2017 | Figiel |
| 2009/0061193 | A1 | | 3/2009 | Hara et al. |
| 2010/0292538 | A1 | | 11/2010 | Hirata et al. |
| 2013/0146239 | A1 | | 6/2013 | Tausche |
| 2016/0024713 | A1 | | 1/2016 | Tan et al. |
| 2018/0142415 | A1 | | 5/2018 | Lee |

FOREIGN PATENT DOCUMENTS

| | | | | |
|---|---|---|---|---|
| EP | 151592 | B1 | | 3/2006 |
| EP | 2074256 | B1 | | 4/2017 |
| WO | WO-94/12725 | | | 6/1994 |
| WO | WO9500702 | W | | 1/1995 |
| WO | WO02072947 | W | | 9/2002 |
| WO | WO2005054573 | W | | 6/2005 |
| WO | WO 2007/063182 | | * | 6/2007 |
| WO | WO2007063182 | W | | 6/2007 |
| WO | WO2011064458 | W | | 7/2011 |
| WO | WO2014106684 | A1 | | 7/2014 |
| WO | WO-2017/052391 | A1 | | 3/2017 |

* cited by examiner

*Primary Examiner* — Mark Halpern

(74) *Attorney, Agent, or Firm* — Thomas W. Barnes, III

(57) ABSTRACT

A method for controlling a fiber fractionation system for fractionating an input material into a long fraction (LF) stream comprising LF fibers and a short fraction (SF) stream comprising SF fibers includes measuring an average LF fiber length at one or more locations post-fractionation, and maintaining the average LF fiber length within a target variability range by automatically altering a rotational speed of a rotor of the fiber fractionation system.

47 Claims, 14 Drawing Sheets

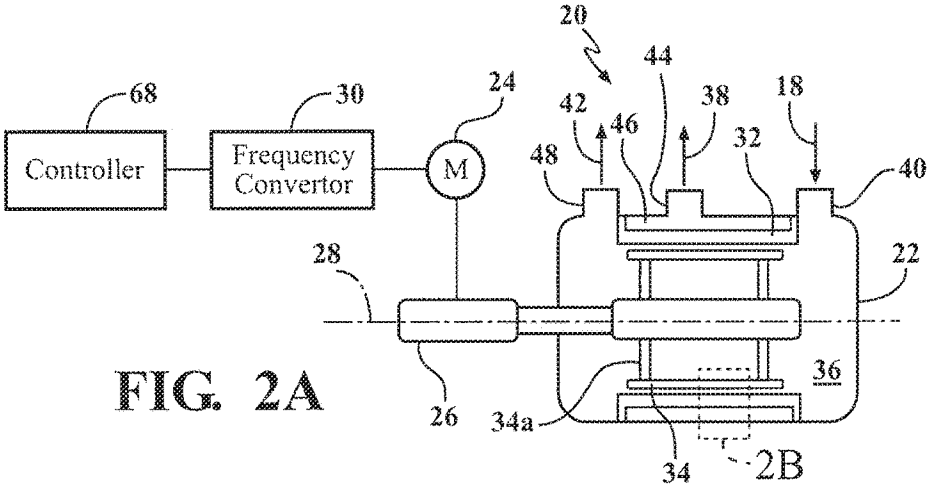
FIG. 2A
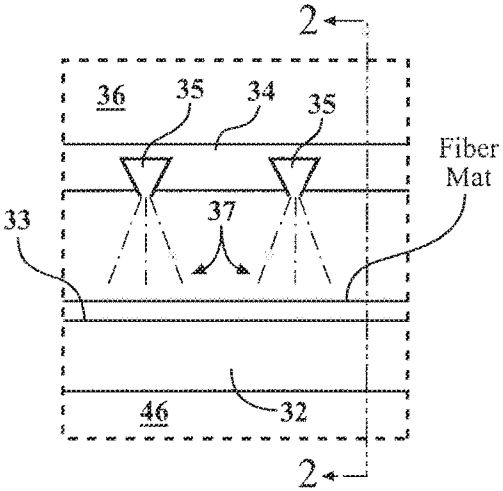
FIG. 2B
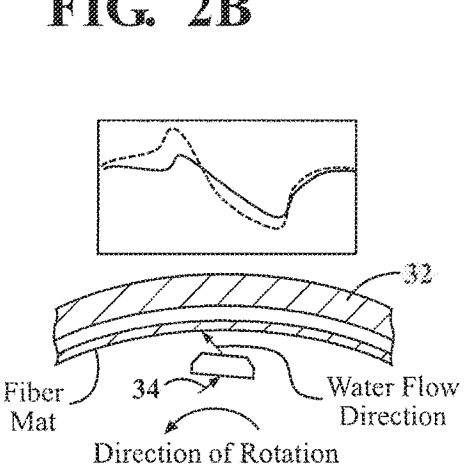
FIG. 2C
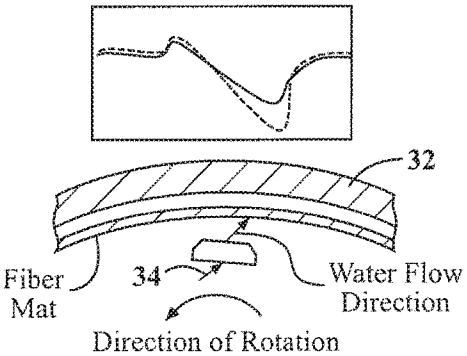
FIG. 2D
FIG. 2E

METHOD AND APPARATUS FOR CONTROLLING A FIBER FRACTIONATION SYSTEM

CROSS-REFERENCE TO RELATED APPLICATIONS

This application claims the benefit of U.S. Provisional Application No. 62/559,861, Sep. 18, 2017 filed, which is herein incorporated by reference in its entirety.

FIELD OF THE INVENTION

This invention relates generally to a stock preparation system comprising a fiber fractionation system and methods and apparatuses for controlling the same.

BACKGROUND OF THE INVENTION

The raw materials used to manufacture paper and industrial packaging board frequently comprise recycled materials, such as old corrugated containers, newspapers, and magazines. These materials typically contain multiple types of wood fibers manufactured either by chemical or mechanical pulping processes and may vary widely in terms of fiber composition and properties. The quality of the input materials defines many of the properties of the end product such as board strength. In addition, the web is subjected to a variety of different forces during the papermaking process, and web properties, such as dewatering resistance and overall runnability, are determined in large part by the properties of the input materials. The volumetric flow rate, content, and consistency of the input stock, as well as the size, configuration, and placement of apertures in the fractionation screen(s), affect fiber-related parameters such as the average fiber length and the ratio of long fraction (LF) and short fraction (SF) fibers.

Conventional papermaking machines are typically operated at a constant mass (solids) flow rate percentage of LF fibers, e.g., 35%, and SF fibers, e.g., 65%. The systems are optimized infrequently because the necessary measurements and adjustments are time-consuming. If a property of the end product, e.g., board strength, falls below a desired value, an operator may choose to increase the weight by area of the web, to add chemicals to modify the strength, and/or to increase the refining energy, all of which increase cost and may result in inefficient use of raw materials and an overall decrease in productivity. The operator may also choose to alter the recipe of the raw materials, which frequently takes several hours to affect the end product.

SUMMARY OF THE INVENTION

In accordance with one aspect of the present disclosure, a method for controlling a fiber fractionation system for fractionating an input material into a long fraction (LF) stream comprising LF fibers and a short fraction (SF) stream comprising SF fibers is disclosed. The method may comprise: measuring an average LF fiber length at one or more locations post-fractionation; and maintaining the average LF fiber length within a target variability range by automatically altering a rotational speed of a rotor of the fiber fractionation system.

In some aspects, the rotational speed of the rotor may be controlled by a frequency converter. In other aspects, measuring the average LF fiber length may be performed immediately after fractionation. In further aspects, measuring the average LF fiber length may be performed after one or more post-fractionation processing steps.

The method may further comprise altering at least one parameter of at least one post-fractionation processing step to maintain the average LF fiber length within the target variability range.

The method may further comprise: measuring one or more properties of a furnish formed by mixing the LF stream and the SF stream; and automatically altering the rotational speed of the rotor of the fiber fractionation system to maintain at least one of the one or more measured furnish properties within a respective target range. In some particular aspects, the one or more measured furnish properties may comprise the average LF fiber length, an average SF fiber length, a measured furnish strength, or a predicted furnish strength.

The method may further comprise: measuring one or more properties of a moving web; and automatically altering the rotational speed of the rotor of the fiber fractionation system to maintain at least one of the one or more measured moving web properties within a respective target range. In some particular aspects, the one or more measured moving web properties may comprise a porosity or a predicted strength property of a finished sheet, the predicted strength property comprising one or more of a short-span compressive strength, a burst strength, or a crush resistance.

The method may further comprise: measuring one or more properties of a finished sheet; and automatically altering the rotational speed of the rotor of the fiber fractionation system to maintain at least one of the one or more measured finished sheet properties within a respective target range. In some particular aspects, the one or more measured finished sheet properties may comprise a basis weight, a porosity, or a strength property, the strength property comprising one or more of a short-span compressive strength, a burst strength, or a crush resistance.

The method may further comprise transmitting a signal to a bale selector to alter a composition of raw material bales selected for an input material. In some particular aspects, the signal is transmitted to the bale selector in response to one of the measured average LF fiber length or a level of stock in a LF fiber storage tank.

The method may further comprise, prior to fractionation, processing a pulp suspension comprising the LF and SF fibers with a turbulence generator.

The method may further comprise, treating a pulp suspension comprising the LF and SF fibers with one or more chemicals to alter an amount of free fines present in the LF and SF streams.

The method may further comprise, during fractionation, applying water to one or more portions of an interior surface of a fractionation screen of the fiber fractionation system.

In some aspects, measuring the average LF fiber length may be performed in real-time.

In other aspects, the fiber fractionation system may comprise an initial mass reject ratio ($RR_m$); and maintaining the average LF fiber length within the target variability range may further comprise automatically altering the initial $RR_m$ to a second $RR_m$.

In accordance with another aspect of the present disclosure, a method for controlling a fiber fractionation system for fractionating an input material into a long fraction (LF) stream comprising LF fibers and a short fraction (SF) stream comprising SF fibers, is disclosed, in which the fiber fractionation system comprises an initial mass reject ratio ($RR_m$). The method may comprise measuring an average LF fiber length at one or more locations post-fractionation; and maintaining the LF average fiber length within a target variability range by automatically altering the initial $RR_m$ to a second $RR_m$.

In some aspects, automatically altering the initial $RR_m$ to a second $RR_m$ may comprise controlling operation of one or more flow control valves. In other aspects, the rotational speed of the rotor may be controlled by a frequency converter.

The method may further comprise transmitting a signal to a bale selector to alter a composition of raw material bales selected for an input material, in which the signal is transmitted in response to one of the measured average LF fiber length or a level of stock in a LF fiber storage tank.

In some aspects, measuring the average LF fiber length may be performed in real-time.

In accordance with another aspect of the present disclosure, a method for controlling a fiber fractionation system for fractionating an input material into a long fraction (LF) stream comprising LF fibers and a short fraction (SF) stream comprising SF fibers is disclosed, in which the fiber fractionation system comprises an initial mass reject ratio ($RR_m$). The method may comprise measuring an average LF fiber length at one or more locations post-fractionation; and maintaining the average LF fiber length within a target variability range by automatically altering: (i) rotational speed of a rotor of the fiber fractionation system; and (ii) the initial $RR_m$ to a second $RR_m$.

In some aspects, the rotational speed of the rotor may be controlled by a frequency converter. In other aspects, measuring the average LF fiber length may be performed immediately after fractionation. In further aspects, measuring the average LF fiber length may be performed after one or more post-fractionation processing steps. In yet further aspects, measuring the average LF fiber length may be performed in real-time.

In accordance with a further aspect of the present disclosure, a method for controlling a fiber fractionation system for fractionating an input material into a long fraction (LF) stream comprising LF fibers and a short fraction (SF) stream comprising SF fibers is disclosed, in which the fiber fractionation system comprises an initial mass reject ratio ($RR_m$). The method may comprise: prior to fractionation, processing a pulp suspension comprising the LF and SF fibers with a turbulence generator; measuring an average LF fiber length at one or more locations post-fractionation; and maintaining the average LF fiber length within a target variability range by automatically altering at least one of: (i) a rotational speed of a rotor of the fiber fractionation system; or (ii) the initial $RR_m$ to a second $RR_m$.

In some aspects, the rotational speed of the rotor may be controlled by a frequency converter. In other aspects, measuring the average LF fiber length may be performed immediately after fractionation. In further aspects, measuring the average LF fiber length may be performed after one or more post-fractionation processing steps. In yet further aspects, measuring the average LF fiber length may be performed in real-time.

In accordance with yet a further aspect of the present disclosure, a method for controlling a fiber fractionation system for fractionating an input material into a long fraction (LF) stream comprising LF fibers and a short fraction (SF) stream comprising SF fibers is disclosed. The method may comprise: measuring an average LF fiber length at one or more locations post-fractionation; and maintaining the average LF fiber length within a target variability range by maintaining the average LF fiber length within a target variability range by treating a pulp suspension comprising the LF and SF fibers with one or more chemicals to enhance binding of fines to the LF fibers, in which the one or more chemicals are added prior to fractionation, during fractionation, or both.

In some aspects, in which the fiber fractionation system comprises an initial mass reject ratio ($RR_m$), maintaining the average LF fiber length within the target variability range further comprises one or more of: automatically altering at least one of: (i) a rotational speed of a rotor of the fiber fractionation system; or (ii) the initial $RR_m$ to a second $RR_m$; or applying, during fractionation, water to one or more portions of an interior surface of a fractionation screen of the fiber fractionation system. In some particular aspects, the rotational speed of the rotor may be controlled by a frequency converter. In other aspects, measuring the average LF fiber length may be performed immediately after fractionation. In further aspects, measuring the average LF fiber length may be performed after one or more post-fractionation processing steps. In yet further aspects, measuring the average LF fiber length may be performed in real-time.

In accordance with yet a further aspect of the present disclosure, a method for controlling a fiber fractionation system for fractionating an input material into a long fraction (LF) stream comprising LF fibers and a short fraction (SF) stream comprising SF fibers is disclosed. The method may comprise: measuring an average LF fiber length at one or more locations post-fractionation; and maintaining the average LF fiber length within a target variability range by treating a pulp suspension comprising the LF and SF fibers with one or more chemicals to reduce binding of fines to the LF fibers, in which the one or more chemicals are added prior to fractionation, during fractionation, or both.

In some aspects, in which the fiber fractionation system comprises an initial mass reject ratio ($RR_m$), maintaining the average LF fiber length within the target variability range further comprises one or more of: automatically altering at least one of: (i) a rotational speed of a rotor of the fiber fractionation system; or (ii) the initial $RR_m$ to a second $RR_m$; or applying, during fractionation, water to one or more portions of an interior surface of a fractionation screen of the fiber fractionation system. In some particular aspects, the rotational speed of the rotor may be controlled by a frequency converter. In other aspects, measuring the average LF fiber length may be performed immediately after fractionation. In further aspects, measuring the average LF fiber length may be performed after one or more post-fractionation processing steps. In yet further aspects, measuring the average LF fiber length may be performed in real-time.

In accordance with yet a further aspect of the present disclosure, a method for controlling a fiber fractionation system for fractionating an input material into a long fraction (LF) stream comprising LF fibers and a short fraction (SF) stream comprising SF fibers is disclosed. The method may comprise: measuring an average LF fiber length at one or more locations post-fractionation; and maintaining the average LF fiber length within a target variability range by applying, during fractionation, water to one or more portions of an interior surface of a fractionation screen of the fiber fractionation system.

In some aspects, in which the fiber fractionation system comprises an initial mass reject ratio ($RR_m$), maintaining the average LF fiber length within the target variability range further comprises one or more of: automatically altering at least one of: (i) a rotational speed of a rotor of the fiber fractionation system; or (ii) the initial $RR_m$ to a second $RR_m$; treating a pulp suspension comprising the LF and SF fibers with one or more chemicals to enhance binding of fines to the LF fibers; or treating a pulp suspension comprising the LF and SF fibers with one or more chemicals to reduce binding of fines to the LF fibers, in which the one or more chemicals are added prior to fractionation, during fractionation, or both. In some particular aspects, the rotational speed of the rotor may be controlled by a frequency converter. In other aspects, measuring the average LF fiber length may be performed immediately after fractionation. In further aspects, measuring the average LF fiber length may be performed after one or more post-fractionation processing steps. In yet further aspects, measuring the average LF fiber length may be performed in real-time. In yet further aspects, applying water to one or more portions of the interior surface of a fractionation screen may comprise spraying, via a forming shower, adjustable pressure water.

In accordance with yet a further aspect of the present disclosure, a method for controlling a fiber fractionation system for fractionating an input material into a long fraction (LF) stream comprising LF fibers and a short fraction (SF) stream comprising SF fibers is disclosed. The method may comprise measuring an average LF fiber length at one or more locations post-fractionation; and adjusting the fiber fractionation system to maintain the average LF fiber length within a target variability range.

In some aspects, adjusting the fiber fractionation system may comprise automatically altering a rotational speed of a rotor of the fiber fractionation system. In other aspects in which the fiber fractionation system comprises an initial mass reject ratio ($RR_m$), adjusting the fiber fractionation system may comprise automatically altering the initial $RR_m$ to a second $RR_m$. In further aspects, adjusting the fiber fractionation system may comprise treating a pulp suspension comprising the LF and SF fibers with one or more chemicals to enhance binding of fines to the LF fibers, in which the one or more chemicals are added prior to fractionation, during fractionation, or both. In yet further aspects, adjusting the fiber fractionation system may comprise treating a pulp suspension comprising the LF and SF fibers with one or more chemicals to reduce binding of fines to the LF fibers, in which the one or more chemicals are added prior to fractionation, during fractionation, or both. In yet further aspects, adjusting the fiber fractionation system may comprise applying, during fractionation, water to one or more portions of an interior surface of a fractionation screen of the fiber fractionation system.

In accordance with yet a further aspect of the present disclosure, a method for controlling a fiber fractionation system for fractionating an input material into a long fraction (LF) stream comprising LF fibers and a short fraction (SF) stream comprising SF fibers is disclosed. The method may comprise measuring an average SF fiber length at one or more locations post-fractionation; and adjusting the fiber fractionation system to maintain the average SF fiber length within a target variability range.

In some aspects, adjusting the fiber fractionation system may comprise automatically altering a rotational speed of a rotor of the fiber fractionation system. In other aspects in which the fiber fractionation system comprises an initial mass reject ratio ($RR_m$), adjusting the fiber fractionation system may comprise automatically altering the initial $RR_m$ to a second $RR_m$. In further aspects, adjusting the fiber fractionation system may comprise treating a pulp suspension comprising the LF and SF fibers with one or more chemicals to enhance binding of fines to the LF fibers, in which the one or more chemicals are added prior to fractionation, during fractionation, or both. In yet further aspects, adjusting the fiber fractionation system may comprise treating a pulp suspension comprising the LF and SF fibers with one or more chemicals to reduce binding of fines to the LF fibers, in which the one or more chemicals are added prior to fractionation, during fractionation, or both. In yet further aspects, adjusting the fiber fractionation system may comprise applying, during fractionation, water to one or more portions of an interior surface of a fractionation screen of the fiber fractionation system.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIGS. 2A-2E are simplified schematic diagrams of a fiber fractionation apparatus, in accordance with the present disclosure;

DETAILED DESCRIPTION OF THE INVENTION

Figure 1:
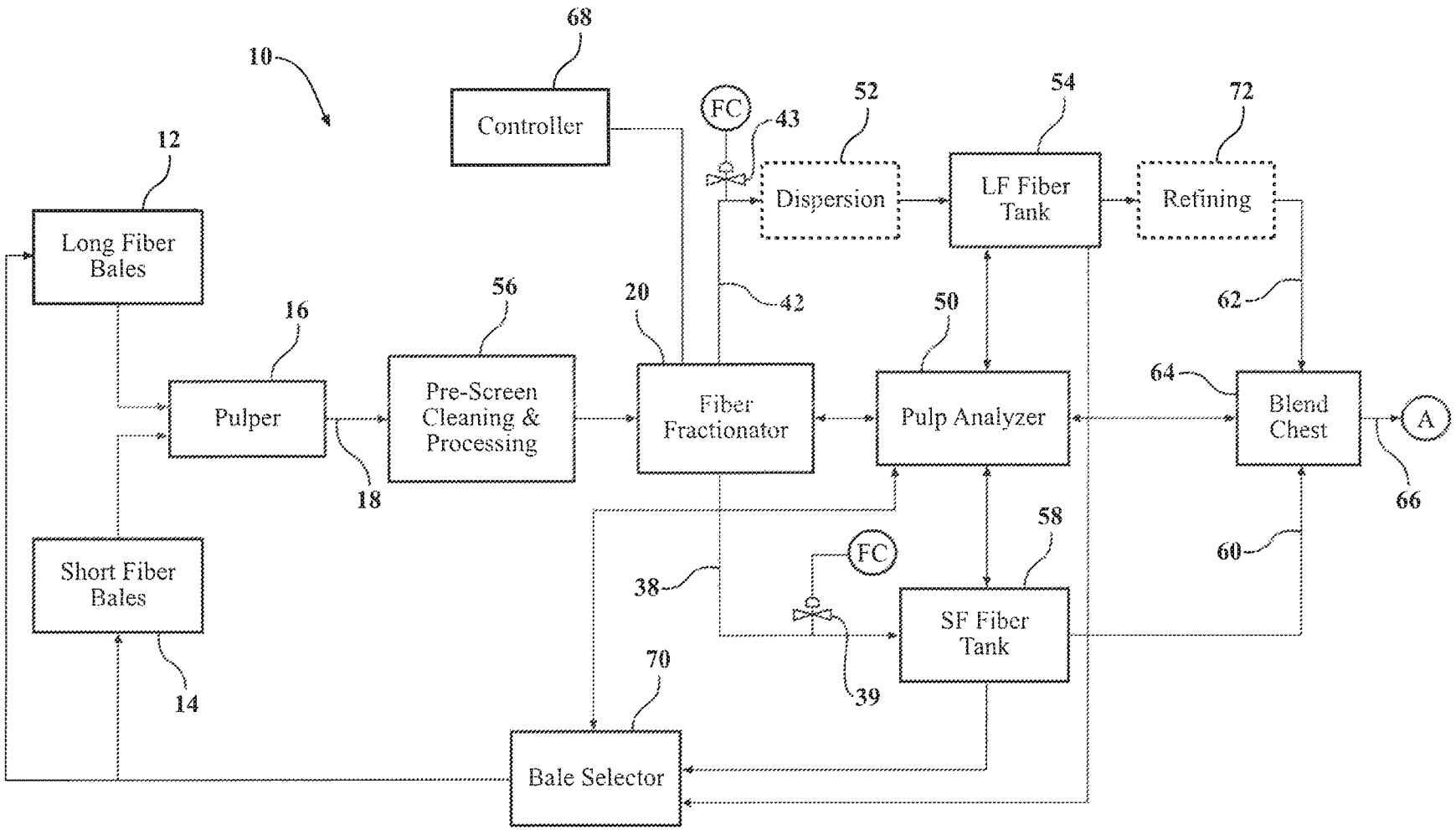
FIG. 1 is a simplified schematic diagram of a pulp preparation and fiber fractionation system, in accordance with the present disclosure.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Strength is one of the most important functional properties of an end product, such as a paper packaging board, particularly compressive strength and burst strength. Both of these strength properties are a function of fiber length and the amount of chemically active bonding sites on the surface of the fibers, both of which depend on the wood species, the fiber manufacturing method used, and any mechanical treatment the fiber material receives during the process. In addition, chemicals, such as starch, may be used to increase the strength of the end product. However, the quality and properties of the raw materials, particularly recycled materials, largely define the achievable strength.

Chemically manufactured (kraft pulping process) softwood fibers are typically the longest, strongest manufactured softwood fiber. Hardwood fibers tend to be much shorter. Typical raw material dimensions may comprise, for example (depending on the geographical region of origin and the pulping method):

Softwood kraft fiber length: 2.4-3.6 mm;

Softwood BCTM/TMP fibers: 1.45-2.0 mm; and

Hardwood kraft fibers: 0.9-1.1 mm.

For many products, the long fibers are often more valuable than the short fibers for several reasons. For example, long fiber strength may be increased with refining, which helps to fibrillate the fiber structure (i.e., to create small "hair-like" fibrils). Fibrillation increases the surface area available for bonding and weakens the internal structure of the fibers, which increases fiber flexibility and further promotes bonding. Thus, investment of energy in refining results in increased strength, while still maintaining dewatering resistances and water holdout properties of the long fraction (LF) fibers within acceptable levels.

In contrast, short fibers often contain a large amount of damaged raw material, such as fibers that have been recycled too many times, fibers that have been cut or otherwise damaged, "fines," i.e., a component of the pulp that passes through a 200 mesh screen, with very low bonding ability, etc. In addition, the short fraction (SF) fibers typically possess a considerably higher dewatering resistance and water holdout capability, as compared to the LF fibers. The majority of the water contained in the raw material suspension must typically be removed during the manufacturing process by: (1) filtration through a wire mesh; (2) pressing against one or more fabrics; and/or (3) drying against hot cylinders. The higher dewatering resistance and water holdout capabilities of the SF fibers increase the difficulty and length of these processes. As a result, attempting to increase the strength of the SF fibers is typically difficult—and sometimes impossible—and increases capital and energy costs.

FIGS. 1-4 are simplified schematic diagrams illustrating a stock preparation system 10 and a papermaking machine 80 in accordance with the present disclosure, in which the average fiber length of a LF fiber fraction is maintained within a predetermined target range. With reference to FIG. 1, a stock preparation system 10 is illustrated. Raw materials are selected from one or more long fiber bales 12, i.e., a bale or collection of dry long fibers, or short fiber bales 14, i.e., a bale or collection of dry short fibers, based on an initial raw material recipe for a grade of a finished product. The raw materials enter a pulper 16, which contains a rotor (not shown) that mixes the dry materials with water and generates shear forces to help break up the raw materials to individual fibers. The dry long fibers may have an average length of, for example, from about 1.5 mm to about 3.6 mm, and the dry short fibers may have an average length of, for example, from about 0.2 mm to about 1.5 mm. The raw materials may have a high degree of variability and may comprise virgin materials, recycled materials, or a mixture thereof with a variety of fiber lengths. In addition, the raw materials may comprise a large amount of debris, fine particulates, and dissolved materials due to the incorporation of increasing amounts of recycled materials. Some large debris is removed from the pulper 16 by coming into contact with a wire or rope suspended into the pulper 16 to collects the debris that is large enough to be immobilized by wrapping around the rope or wire. This device, known as a "ragger tail," is extracted from the pulper 16 to remove this large debris.

A pulp suspension 18 formed by the pulper 16 may comprise, for example, about 2-4% solids with the remainder being substantially water for a low consistency pulper and about 10-20% solids with the remainder being substantially water for a high consistency pulper. The pulp suspension 18 may undergo one or more cleaning and/or processing steps prior to and/or during fractionation (generally represented by the block labeled pre-screen cleaning/processing 56 in FIG. 3), which are illustrated in more detail in FIG. 4. These cleaning/processing steps 56 may comprise separate steps and/or two or more of the steps 56 may be performed in combination. The order of the cleaning/processing steps 56 may also be varied based on the design of the stock preparation system 10 and downstream requirements. With reference to FIG. 4, the one or more cleaning steps may include a course cleaning step 56*a* to remove large debris, such as baling wire and other metal, stones, pieces of plastic, etc. The pulp suspension 18 is introduced into one or more coarse cleaners, which are large, cone-shaped devices. Pulp rotates inside the cone at very high speed, and centrifugal force acting on the pulp suspension 18 will separate heavier particles from the pulp. These particles are then removed from the bottom of the cone, while the "good pulp" is sent forward from the top of the cone. The one or more cleaning steps may include use of one or more pressure screens 56*b*. Lighter particles, such as small pieces of plastic, etc., will be removed based on size with the aid of slotted or holed screens. The one or more cleaning steps may also comprise use of centrifugal force 56*c* to remove sand and glass using known methods.

In some embodiments, the one or more processing steps may comprise the use of a floc breaking device 56*d* such as a turbulence generator. An example of a turbulence generator is a plate with holes inside a pipe. The hole size is selected to be large enough, such as more than 10 mm, depending on the pulp characterization, that a mat is not formed on the plate, yet small enough that it creates a local velocity difference near the plate, as compared to the flow velocity profile of pipe flow. This flow velocity difference will generate shear forces in the flow, which are the means of breaking the flocs, i.e., groups of fibers and other materials that are clumped together. The use of the floc breaking device 56*d* may take place prior to fractionation.

In other embodiments, the one or more additional processing steps may also comprise the application of one or more chemicals 56*e* that impact the retention or removal of certain components in the pulp suspension 18. In one example, starch and/or a charged (e.g., cationic) polymer such as polyacrylamide may be added to the pulp suspension 18 to cause the fines to bind to the fibers. In another example, a colloidal silica sol or defoamer such as FennoTech® 1722 (Kemira®) or the EKA NP™ product line (AkzoNobel® N.V.) may be added to the pulp suspension 18, to repel the fines from the fibers. The chemical(s) applied to the pulp suspension 18 may be chosen based on the quality of the post-fractionation materials, as described herein, and based on the requirements of the finished product (not shown; see FIG. 3), such as the grade. The one or more chemicals may be added prior to and/or during fractionation. For example, a charged polymer may be added prior to fractionation (e.g., prior to the pulp suspension 18 entering a fiber fractionation apparatus 20), and a colloidal silica sol may be added during fractionation (i.e., in the fiber fractionation apparatus 20), as described herein. The addition of chemicals 56*e* may also be used effect control of the average fiber length of the LF fiber fraction, as described herein.

Dilution water may be added to the pulp suspension 18, and the pulp suspension 18 then passes into the fiber fractionation apparatus 20 comprising one or more fractionation stages. A simplified, cross-sectional view of a fiber fractionation apparatus 20 comprising a pressure sorter is illustrated in FIGS. 2A-2E. Examples of pressure sorters are explained in detail in U.S. Pat. Nos. 4,276,159; 5,566,833; and 5,601,192. Other types of suitable fractionation apparatuses may include, for example, a centrifugal cleaner.

With reference to FIG. 2A, the pressure sorter 20 generally comprises a cylindrical housing 22 and a motor 24 fixed to a rotor shaft 26 that rotates about an axis 28. The motor 24 is coupled to a frequency converter 30 that allows a rotational speed (i.e., the revolutions per minute (RPM)) of the rotor shaft 26 to be controlled, as described herein. A cylindrical screen 32 is mounted, i.e., fixed, to an interior surface of the cylindrical housing 22 and defines a space 46 between the housing 22 and the screen 32. The screen 32 is concentric with the housing 22 and the axis 28. The screen 32 comprises a plurality of perforations or apertures (not shown), which may comprise a variety of holes, channels, and/or slots, as is known in the art. Vanes 34 are coupled to the rotor shaft 26 via a plurality of support rods 34*a*. Although the pressure sorter 20 depicted in FIG. 2A is single-stage, those skilled in the art will appreciate that the pressure sorter 20 may comprise one or more additional stages.

As is known in the art, the pulp suspension 18 enters the fiber fractionation apparatus 20 via an intake pipe 40 and passes into an internal chamber 36 of the housing 22. The rotation of rotor shaft 26 and the vanes 34 causes the pulp suspension 18 to move in a helical line through the internal chamber 36 from a front end, e.g., near the intake pipe 40, toward a back end, e.g., near outlet pipe 48. A portion 38 of the pulp suspension 18 comprising shorter fibers (also referred to as the SF fibers or the accepts/accepted material) is forced through the apertures in the screen 32 and enters the space 46 defined between the housing 22 and the screen 32. The stream comprising the SF fibers then exits the pressure sorter 20 via a first outlet pipe 44. The remaining portion 42 of the pulp suspension 18 comprises the longer fibers (also referred to herein as the LF fibers or the rejects/rejected material) that do not pass through the screen 32. The stream comprising the LF fibers 42 continues down the length of the internal chamber 36 and exits via a second outlet pipe 48. The fiber fractionation apparatus 20 may comprise one or more flow consistency meters (not shown) that measure a mass flow rate and/or a volumetric flow rate of the respective streams comprising the SF and LF fibers 38, 42. The mass flow rate of the SF fibers 38 may be controlled via a control valve 39, the operation of which is controlled by an associated flow control unit (FC), which functions to open and close the valve 39. The mass flow rate of the LF fibers 42 may be similarly controlled via a control valve 43 and corresponding flow control unit (FC), which functions to open and close the valve 43. The flow control units associated with the valves 39 and 43 may be coupled to and controlled via a controller 68.

In general, the selectivity and quality of the screening performed by the fiber fractionation apparatus 20 decreases as the rotational speed of the rotor shaft 26 increases, and vice versa. In addition, rotation of the rotor shaft 26 and vanes 34 creates a pressure difference between the internal chamber 36 and the space 46 between the housing 22 and the screen 32. In general, a pressure in the space 46 is less than a pressure in the internal chamber 36, which helps to draw material into the space 46. This pressure difference is affected by the consistency of the pulp suspension 18 entering the fiber fractionation apparatus 20, the attributes of the apertures in the screen 32 (e.g., size, configuration, and placement), the available screen area, and the mass flow rate reject ratio (also referred to herein as the mass reject ratio ($RR_m$); the rejects comprise the LF fibers 42).

FIG. 2B is an enlarged view of a section of the screen 32 and a vane 34 of FIG. 2A, and FIGS. 2C-2E are partial cross-sectional views taken along line 2-2 in FIG. 2B. As shown in FIG. 2B, in some embodiments, the fiber fractionation apparatus 20 may comprise a forming shower 35 that applies water 37 to an interior surface 33 of the screen 32. The forming shower 35 may comprise, for example, a slot or a nozzle located in one or more of the vanes 34 that supplies, i.e., sprays, water 37 onto the interior surface 33 of the screen 32. In some examples, the forming shower 35 may provide adjustable pressure water 37. In other examples, the water 37 provided by the forming shower 35 may comprise a pulsating flow.

The water 37 provided by the forming shower 35 may be used to dislodge a fiber mat that frequently forms on the interior surface 33 of the screen 32 and to ensure more uniform screening along the length of the screen 32, e.g., to avoid a capacity drop along one or more portions of the screen 32 due to fiber accumulations of varying thickness. The fiber mat comprises fines that have become trapped on the interior surface 33 of the screen 32. The water 37 provided by the forming shower 35 adds dilution water to the stream of LF fibers 42 exiting the internal chamber 36 and pushes at least a portion of the fines out with the LF fibers 42. The water 37 provided by the forming shower 35 also adds dilution water to the stream of LF fibers 42 to minimize the thickening effect of the screen 32, allowing more efficient passage of the short fibers 38 through the screen 32. The forming shower 35 may further be used to introduce one or more chemicals (see 56 and 56E in FIGS. 1 and 4) into the fiber fractionation apparatus 20 during fractionation.

As shown in FIGS. 2C-2E, the water 37 from the forming shower 35 may impact the fiber mat and the screen 32 in a direction that is substantially perpendicular to the interior surface 33 of the screen 32 (FIG. 2C) or at an angle that is against a rotation direction of the vane 34 (FIG. 2D) or toward the rotation direction of the vane 34 (FIG. 2E). As is known in the art, the vane 34 may comprise a foil, and during rotation, the vanes 34 create negative pressure on an upper surface, e.g., the surface facing the screen, and positive pressure on a lower surface due to the Coandă effect. The pressure pulses generated by the vanes 34 are illustrated by the solid lines in the pressure curves shown in FIGS. 2C-2E. The negative pressure pulses help to lift the fiber mat from the interior surface 33 of the screen 32. The water 37 supplied by the forming shower 35 impacts the Coandă effect of the vanes 34. This impact is illustrated in the pressure curves associated with each of FIGS. 2C-2E, in which the dashed line represents a pressure pulse generated by the vanes 34 with the forming shower 35. The forming shower 35 may also be used effect control of the average fiber length of the LF fiber fraction, as described herein.

After fractionation, the SF fibers 38 typically undergo no additional treatment and are pumped to a SF fiber storage tank 58 for storage. The LF fibers 42 may optionally undergo one or more post-fractionation processing steps such as dispersion 52 and refining 72. During the dispersion process 52, the temperature of the LF fibers 42 is increased to an optimum value based the fiber material and properties of any remaining impurities, and a mechanical shear force (e.g., a low intensity refiner/shredder) is applied to the LF fibers 42. Dispersion 52 helps to remove some impurities from the LF fibers 42 (e.g., stickies) and to improve the pulp strength by removing fiber curl/latency from the LF fibers 42. The LF fibers 42 are then pumped to a LF fiber storage tank 54 for storage. The LF fibers 42 may also undergo refining 72. Refining 72 may comprise one or more mechanical treatments designed to increase fibrillation of the LF fibers 42, which promotes bonding and increases fiber flexibility and pulp strength. Refining is described in greater detail in Valmet (Published Nov. 30, 2012). *Mill Scale Trial of Selective Refining of TMP Long Fiber Fractions*. Retrieved from http://www.valmet.com/globalassets/media/downloads/white-papers/board-and-paper-making/wppb_trialselectiverefining.pdf; and Nazhad, M. M. (2004). Limitation of Fiber Fractionation-Refining Process to Improve Paper Strength Using Recycled OCC Pulp. In T. Ona (Ed.), *Improvement of Forest Resources for Recyclable Forest Products* (pp. 63-65). Tokyo, Japan: Springer, each of which is herein incorporated by reference in its entirety.

A first input stock flow 60 comprising the SF fibers 38 and a second input stock flow 62 comprising the LF fibers 42 may be mixed with water and/or one or more liquids and/or additives, such as clay and/or starch, in a blend chest 64 to form a furnish 66.

The stock preparation system 10 may further comprise a pulp analyzer 50 that may be coupled to one or more components of the stock preparation system 10 to analyze one or more attributes of the materials. For example, the pulp analyzer 50 may be coupled to the fiber fractionation apparatus 20 to measure fiber properties in the pulp suspension 18 before fractionation. The pulp analyzer 50 may also measure fiber properties of the SF fibers 38 and/or the LF fibers 42 after fractionation. In some examples, the fiber properties of the SF and/or LF fibers 38, 42 may be analyzed immediately after leaving the fiber fractionator 20. In other examples, the fiber properties of the SF and/or LF fibers 38, 42 may be analyzed after one or more additional processing steps as described herein. The pulp analyzer 50 may also be coupled to the blend chest 64 and may analyze one or more properties of the furnish 66. In some examples, the fiber properties comprise measurement of an average fiber length of one or both of the SF and LF fibers 38, 42. In other examples, the properties may include, but are not limited to, consistency, ash content, size distribution, fibrillation, number and size of flocs, kink, kink angle, curl, freeness coarseness (length mass), fiber width, vessel element count, vessel element dimensions (length and width), shive count, shive dimensions (length and width), and fines content, including both fibril-like long fines and round shaped particles. The pulp analyzer 50 may comprise, for example, a Valmet® MAP Pulp Analyzer (Valmet Corp.).

The stock preparation system 10 may further comprise an electronic controller 68 that may be coupled to one or more components of the system 10. The controller 68 may comprise any kind of a device which receives input data, processes that data through computer instructions, and generates output data. Such a controller 68 can be a microcontroller, a hand held device, laptop or notebook computer, desktop computer, microcomputer, digital signal processor (DSP), mainframe, server, cell phone, personal digital assistant, other programmable computer devices, or any combination thereof. Such controllers 68 can also be implemented using programmable logic devices such as field programmable gate arrays (FPGAs) or, alternatively, realized as application specific integrated circuits (ASICs) or similar devices. The term "controller" is also intended to encompass a combination of two or more of the above recited devices, e.g., two or more microcontrollers.

Although the controller 68 is depicted in FIG. 1 as being coupled only to the fiber fractionation apparatus 20, those skilled in the art will understand that the controller 68 may be coupled to, for example, the pulper 16, the pulp analyzer 50, the LF and SF fiber tanks 54, 58, and the valve flow control units as noted above, etc. The system 10 may also comprise two or more controllers (not shown). One or more sensors (not shown) may be present at multiple locations within the stock preparation system 10 and may be coupled to the controller(s) 68. For example, volumetric flow, consistency, fiber image analyzer or level sensors, such as one or more differential pressure cells and/or ultrasonic sensors, may be located in each of the LF and SF fiber tanks 54, 58 and may provide a tank level to a bale selector 70, as described herein. One or more temperature, flow rate, and/or flow consistency sensors may also be coupled to the lines (not labeled) connecting the LF and SF fiber tanks 54, 58 to the blend chest 64 and may measure, for example, a temperature, volumetric flow rate, and other characteristics of the first and second input stock flows 60, 62. Sensors may further be located between the pulper 16 and the fiber fractionation apparatus 20 to measure similar characteristics of the pulp suspension 18.

Figure 3:
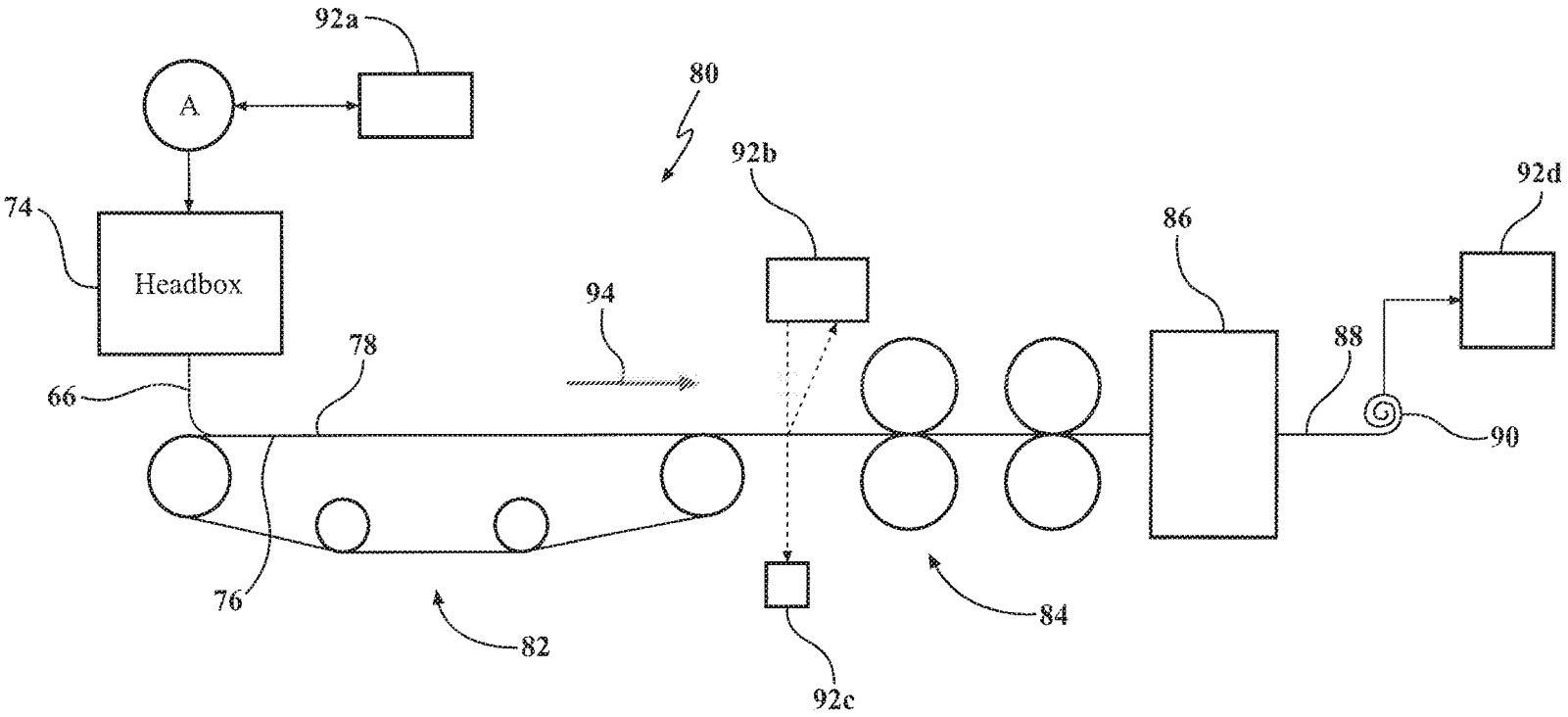
FIG. 3 is a simplified schematic diagram of a papermaking machine, in accordance with the present disclosure.
Figure 4:
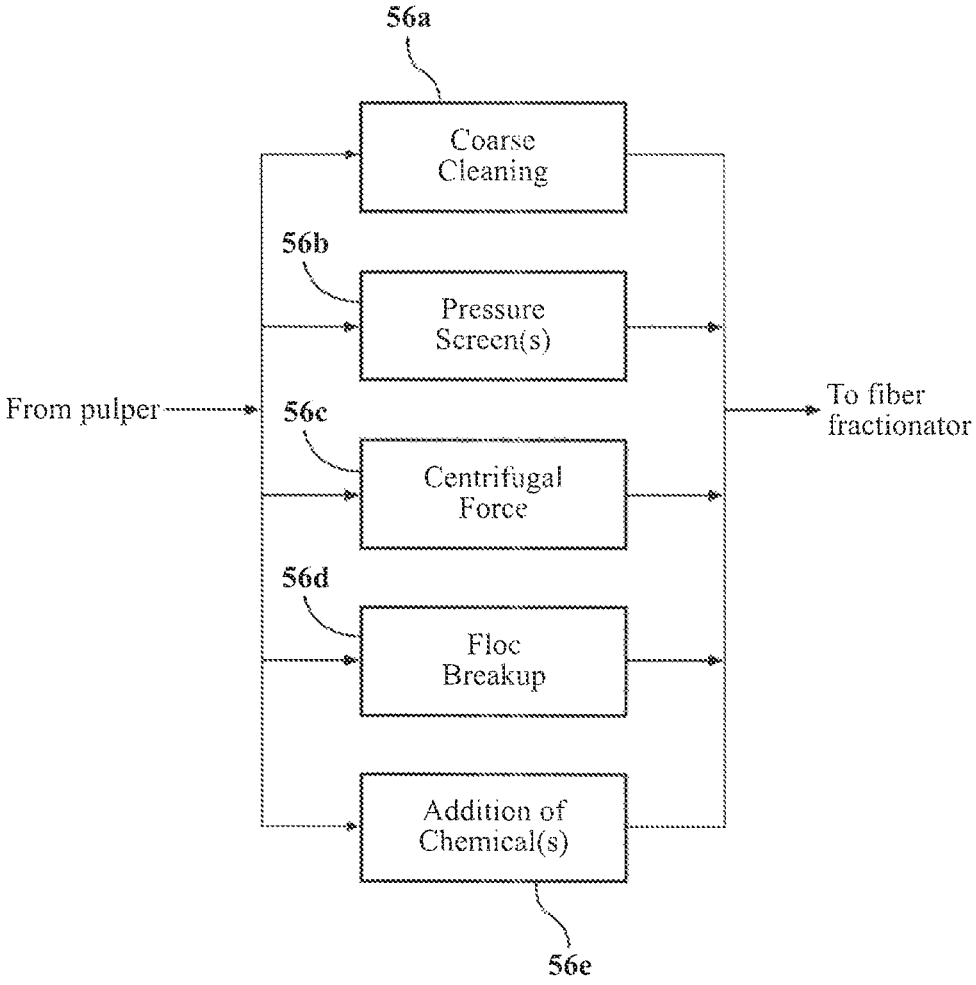
FIG. 4 is a simplified schematic diagram of one or more additional cleaning and/or processing steps that may take place prior to and/or during fractionation, in accordance with the present disclosure.

FIG. 3 is a high-level depiction of a papermaking machine 80. As shown in FIG. 3, the furnish 66 from the stock preparation system 10 enters a headbox 74 of the papermaking machine 80 and is deposited from the headbox 74 onto a bottom forming wire 76 to form a moving web 78. The web 78 moves along with the bottom forming wire 76 in the direction depicted by arrow 94 and passes through several sections or stages, including a dewatering stage (generally represented as 82), one or more rollers, calender rolls, and/or roll presses (generally represented as 84), and a drying stage (generally represented as 86). Following the drying stage 86, the web 78 emerges as a dried, finished product 88, which may be taken up on a roll 90.

In-line measurement sensors and devices 92*a-c* may be located at various points in the papermaking machine 68 as known in the art and may measure a variety of properties of the web 78 and/or the finished product 88 including, but not limited to, in-plane ultrasonic modulus, out of plane ultrasonic modulus, basis weight, moisture, caliper, opacity, formation, topography, brightness, and finish. For example, the device 92*a* may comprise a device for forming handsheets, as is known in the art. The device 92*a* may be used to measure or estimate properties of the handsheet such as strength (STFI, burst, tensile, etc.), porosity, color/shade, and contamination (dirt, stickies, metal, etc.). Devices 92*b* and 92*c* may comprise a light source and a spectrophotometer for measuring light absorption, scattering, etc. A device 92*d* may be used to analyze or estimate one or more properties of the finished product 88, such as basis weight, color/shade, thickness (caliper), moisture, ash (filler), contamination (dirt, stickies, metal, etc.), compressive strength, burst strength, porosity, and crush resistance based on, for example, the Concora Corrugating Medium Test, the Gurley method, and/or measurements of in-plane and out-of-plane ultrasonic modulus of elasticity. These devices 92*a-d* may be coupled to the controller (not shown; see FIG. 1).

In conventional stock preparation systems, the fiber fractionation apparatus is generally designed to produce a certain mass (solids) flow rate percentage, e.g., 30-40%, of LF fibers from a total mass (solids) flow rate of input fibers, with a design midpoint being, for example 35%. If the mass (solids) flow rate percentage of LF fibers is 30-40%, then the mass (solids) flow rate percentage of SF fibers is 60-70%, with a design midpoint being, for example, 65%. Such stock preparation systems typically operate using set (i.e., constant) mass (solids) flow rate percentages, such as 35% long fiber and 65% short fiber, and any adjustments must be made manually. Hence, in this example, 35% of the input solids are delivered to the LF fiber tank 54 and 65% of the input solids are delivered to the SF fiber tank 58 at all times during operation. However, when properties of the raw materials change, such as the average fiber length, the average fiber length of the fibers (solids) being delivered to the LF fiber tank 54 and the SF fiber tank 58 will vary accordingly, which leads to undesirable variations in board strength and other properties of the end products. For example, the average length of the LF fibers 42 going to the LF fiber tank 54 may fall below a desired or minimum length threshold.

In addition, these conventional systems often lack the capability to make in-line measurements of fiber properties, such as fiber length, or such measurements are taken only infrequently. Analysis of fiber properties is typically performed offline in a laboratory, which is time-consuming. For example, fully measuring a two-stage screening system requires about one full work day. Thus, any optimization of parameters related to fiber properties is often performed during the initial system setup and only very infrequently thereafter, if at all. As discussed herein, decreases in strength may be addressed by increasing the weight by area of the product, using chemical additives to increase strength, and/or increasing refining energy. However, these solutions all increase capital and/or energy costs and may result in inefficient use of the raw materials. The operator may also choose to change the recipe of the raw, input materials, but there is a significant lag (typically 6-10 hours) between when the recipe is changed and when this change is reflected in the end product.

The stock preparation system in accordance with the present disclosure solves these problems using active control of the stock preparation system based on continuous, in-line (real-time or near real-time) measurements of fiber length to achieve a nearly constant average fiber length of the LF fibers going to the LF fiber tank 54. Active control of the average LF fiber length may be achieved by controlling the rotational speed of the rotor shaft 26, the mass reject ratio ($RR_m$), and/or a quantity of fines in the pulp suspension 18 and/or combinations thereof.

With reference to FIGS. 1 and 2A, in one embodiment, the controller 68 may be used to effect a fine control of the average LF fiber length by automatically altering the rotational speed of the rotor shaft 26. As shown in FIG. 2A, a power source (not shown) provides current to the frequency converter 30, which then drives the motor 24. The frequency converter 30 may be coupled to the controller 68, and the controller 68 may provide a control signal to the frequency converter 30 that controls the frequency of the input power delivered to the motor 24, thereby controlling the rotational speed (revolutions per minute) of the rotor shaft 26. In general, if the rotational speed of the rotor shaft 26 is increased, the selectivity of the screen 32 decreases as longer fibers are forced through the screen 32 and into the stream of SF fibers 38. Thus, the average fiber length of the LF fibers 42 will generally decrease as the rotational speed of the rotor shaft 26 increases, and vice versa. Alteration of the rotational speed of the rotor shaft 26 generally has little effect on the $RR_m$, as described herein.

The controller 68 may receive information from, for example, the pulp analyzer 50 indicating that the average fiber length of the LF fibers 42, as measured immediately after fractionation (e.g., as the stream of LF fibers 42 is exiting the second outlet pipe 48), has dropped below a predefined minimum threshold value (i.e., below the lowest value within a target variability range). In response to this information, the controller 68 alters the control signal supplied to the frequency converter 30 to decrease the rotational speed of the rotor shaft 26, thereby increasing the average fiber length of the LF fibers 42 and maintaining the average LF fiber length within a target variability range. The controller 68 may make similar alterations to the rotational speed of the rotor shaft 26 in response to fiber length measurements taken by the pulp analyzer 50 after dispersion 52 and/or after refining 72.

In another embodiment, the controller 68 may be used to may be used to effect a coarse control of the average LF fiber length by automatically altering the $RR_m$, which may be calculated as follows:

$$RR_m = \frac{m_R}{m_F} = \frac{c_R V_R}{c_F V_F}$$

in which $m_R$ is the mass (solids) flow rate in the reject (i.e., the LF fiber 42) stream (kg/sec); $m_F$ is the mass (solids) flow rate in the input or feed stream (kg/sec); $c_R$ is the consistency or solids of the reject pulp (%); $c_F$ is the consistency or solids of the feed pulp (%); $V_R$ is the mass (solids plus liquid) flow rate of the reject stream (liters/sec); and $V_F$ is the mass (solids plus liquid) flow rate of the feed stream (liters/sec).

For example, an initial $RR_m$ of 35% for the LF fibers 42 (i.e., the control valve 43 is in a first, at least partially open position) may result in an average LF fiber length that is below the predefined minimum threshold value, as measured by the pulp analyzer 50. The average LF fiber length may be altered by adjusting the initial $RR_m$ to a second $RR_m$ by opening or closing, i.e., increasing or decreasing the flow rate through, the control valve 43 via the corresponding flow control unit and moving the control valve 43 to a second position. For example, further opening the control valve 43 increases the initial $RR_m$ to a higher, second $RR_m$ because a greater proportion of the pulp suspension 18 then bypasses the screen 32 and enters the stream comprising the LF fibers 42. However, because the screen 32 is bypassed, the stream comprising the LF fibers 42 contains a greater number of shorter fibers, which decreases the average LF fiber length. Decreasing the opening of, i.e., further closing, the control valve 43 decreases the initial $RR_m$ and increases the average LF fiber length. Similar control of the $RR_m$ may be accomplished by opening and closing of the control valve 39 that controls flow of the SF fibers 38. Thus, opening and closing of the valves 39, 43 may be used as a coarse adjustment to maintain the average LF fiber length within the target variability range.

In a further embodiment, the controller 68 may effect a fine control of the average LF fiber length by controlling a quantity of free, i.e., unbound, fines in the pulp suspension 18. As described herein, one or more chemicals may be added (see 56 and 56*e* in FIGS. 1 and 4) prior to and/or during fractionation, and these chemicals either repel the fines from the LF fibers 42 (i.e., increase the quantity of free fines) or bind the fines to the LF fibers 42 (i.e., decrease the quantity of free fines). Also as described herein, a forming shower 35 (see FIGS. 2B-2E) may supply water 37 to wash a portion of the fines from the LF fibers 42 and to break up the fiber mat containing fines that may accumulate on the screen 32 during fractionation, both of which increase the quantity of free fines. Increasing the quantity of free fines typically enhances the selectivity of the screen 32, which increases the average LF fiber length, and decreasing the quantity of free fines causes a decrease in the average LF fiber length. Similar to altering the rotational speed of the rotor shaft 26, controlling the quantity of free fines generally has little impact on the $RR_m$ but has a greater impact on fractionation efficiency.

In a further embodiment, the controller 68 may use a combination of the rotational speed of the rotor shaft 26, the quantity of free fines, and/or the $RR_m$ as described herein to achieve the desired average LF fiber length. For example, the initial $RR_m$, quantity of fines, and rotational speed of the rotor 26 may result in the average LF fiber length dropping below the predefined minimum threshold value. The control valve 43 may be closed slightly to reduce the initial $RR_m$ to a lower, second $RR_m$ and the rotational speed of the rotor 26 may also be reduced slightly, both of which result in an increase in the average LF fiber length and maintain the average LF fiber length within the target variability range. Along with adjusting the $RR_m$ and/or the rotational speed of the rotor 26, the quantity of free fines may be adjusted as described herein to increase the average LF fiber length and maintain the average LF fiber length within the target variability range. In general, the rotational speed of the rotor 26 and quantity of free fines have little impact on the $RR_m$ but have a greater impact on fractionation efficiency, e.g., the average LF fiber length. In contrast, opening and closing of the control valves 39 and/or 43 affects both the average LF fiber length and the $RR_m$, which may introduce undesirable variability in downstream processes. For example, when the control valve 43 is opened further, more SF fibers 38 enter the stream of LF fibers 42, which may affect the efficiency of refining and other post-fractionation steps. In addition, opening and/or closing of the control valves 39 and/or 43 affects the amount of mass (solids) entering the LF and SF fiber storage tanks 54, 58, which may lead to shortages or excesses of the SF or LF fibers 38, 42, as described herein. Thus, opening and closing of the control valves 39 and/or 43 may be used to achieve coarse control of average LF fiber length, while controlling the rotational speed of the rotor 26 and/or the quantity of free fines may be used to achieve fine control of the average LF fiber length.

In some embodiments, the controller 68 may make alterations to the operating parameters of one of more components of the stock preparation system 10 in response to measurements provided by the pulp analyzer 50 from other locations. For example, the pulp analyzer 50 may measure one or more properties of the furnish 64 in the blend chest 64, such as the average LF fiber length, an average SF fiber length, freeness, coarseness, fines content, etc., or a furnish strength measured on handsheets or predicted from pulp properties, such as tensile, burst, and/or short span compressive strength, and the many other properties that can be measured. Based on these measurements, the controller 68 may alter the rotational speed of the rotor shaft 26 and/or the $RR_m$ in order to, for example, maintain the average LF fiber length within the target variability range, as described herein. In addition, the controller 68 may, for example, make alterations to the dispersion and/or refining steps 52, 72.

With reference to FIGS. 2 and 3, in a further embodiment, the controller 68 may make alterations to the operating parameters of one of more components of the stock preparation system 10 in response to information received from one or more of the measurement devices 92*a-d* regarding one or more properties of the moving web 78 and/or the finished product 88. In one example, one or more of the devices 92*a-c* may measure one or more properties of the moving web 78, such as optical properties or strength predictors, such as in-plane and out-of-plane ultrasonic modulus of elasticity. Based on these measurements, the controller 68 may alter the rotational speed of the rotor shaft 26 and/or the $RR_m$ in order to, for example, maintain the average LF fiber length within the target variability range, as described herein, or to maintain the strength and/or other properties within a target variability range. In another example, the device 92*d* may measure one or more properties of the finished product 88, such as a basis weight, strength predictors such as in-plane or out-of-plane ultrasonic modulus. In a particular example, measurements or predictions of compressive and/or burst strength of the finished product 88 taken by the measurement device 92*d* may indicate that the compressive and/or burst strength has fallen below a minimum threshold value. These measurements may be transmitted to the controller 68, and as described herein, the controller 68 may automatically alter one or both of the rotational speed of the rotor shaft 26 and the $RR_m$ to maintain the compressive and/or burst strength within a target range. For example, the controller 68 may decrease the rotational speed of the rotor shaft 26 in order to increase the average fiber length of the LF fibers 42, thereby increasing the strength of the finished product 88. In both examples, the controller 68 may, for example, make alterations to one or more additional upstream steps, such as the dispersion and/or refining steps 52, 72, in response to information received from the one or more measurement devices 92*a-d*.

By maintaining the average LF fiber length within a predetermined target variability range, the composition of the stream of LF fibers 42 and the second input stock flow 62 are more homogeneous, which makes it easier to build reliable process models to control the subsequent processing steps, such as dispersion and refining as described herein. For example, fiber length and freeness typically correlate well with each other. Longer fibers generally have a lower dewatering resistance and a higher freeness measurement value (Canadian standard freeness (CSF)). If the average LF fiber length is kept constant, the impact of fiber length on target freeness may be eliminated, as the value should not change appreciably. Thus, the freeness value more accurately describes the raw material strength potential and may be optimized to a greater extent, resulting in greater and more consistent increases in the strength of the end product.

It is important that the maximum number of long fibers are recovered from the raw materials and directed to the line containing the LF fibers 42 that will undergo additional processing steps such as refining to increase the strength of the LF fiber fraction, as described herein. Any long fibers that remain with the SF fibers 38 will not receive these additional treatments. Careful monitoring of the selectivity and quality of the screening performed by the fiber fractionation apparatus 20 is needed to ensure that the pulp suspension 18 is being properly fractionated.

The embodiments described herein involve measurement of the average length of the LF fibers 42, but in other embodiments, an average length of the SF fibers 38 may also be measured, and the operation of the fiber fractionation apparatus 20 may be controlled as described herein to maintain the average SF fiber length within a target variability range.

In addition, with reference to FIG. 2A, the stock preparation system 10 in accordance with the present disclosure may generate an alert to change the composition of the raw materials, e.g., the long and short bales 12, 14, in order to maintain a level in the LF fiber storage tank 54 within a predetermined target range. For example, if measurements indicate that the average LF fiber length has fallen below a minimum threshold value, alterations are made as described herein to bring the average LF fiber length back above the minimum value and to maintain the average LF fiber length within a target variability range. These changes, in particular changes to the $RR_m$, may lead to an overall reduction in the volume of LF fibers 42, and if no changes are made to the raw, input materials, the level in the LF fiber storage tank 54 may drop below a minimum threshold value (i.e., below the lowest value in a target variability range), and the process will eventually run out of LF fibers 42. In the opposite situation in which the average LF fiber length exceeds a maximum threshold value, there is a surplus of LF fibers 42, and the level in the LF fiber storage tank will rise above a maximum threshold value and/or result in a shortage of the SF fibers 38 with respect to the LF fibers 42.

To prevent these shortfalls and excesses, the stock preparation system 10 may alert field operators to change the raw material composition, e.g., to choose bales of raw material with a higher or lower proportion of long fibers. For example, a sensor (not shown) may detect that the level in the LF fiber storage tank 58 has fallen below a minimum threshold value and may transmit this information to the controller 68. The controller 68 may then transmit a signal to the bale selector 70, which changes the recipe of input materials to include, for example, a greater proportion of long fiber bales 12. The controller 68 may also transmit a signal to the bale selector 70 to change the recipe of input materials when the controller receives information from the pulp analyzer 50 indicating that the average LF fiber length is above or below the target variability range. These alerts ensure that the level in the LF fiber storage tank 54 remains within a specified range and that there are sufficient amounts of SF and LF fibers 38, 42 for downstream manufacturing applications. These raw material management procedures may be created during initial setup and may be altered as needed during the process.

Figure 5:
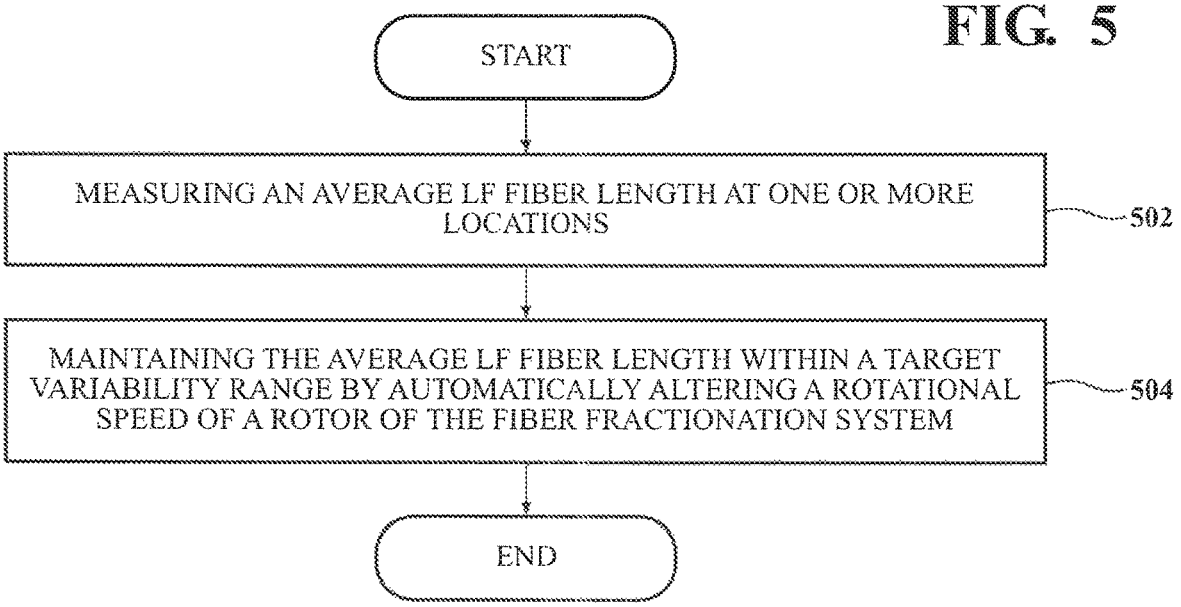
FIGS. 5-21 are flowcharts of exemplary methods for controlling a fiber fractionation system, in accordance with the present disclosure.

The flowcharts of FIGS. 5-21 depict exemplary methods for controlling a fiber fractionation system for fractionating an input material into LF stream comprising LF fibers and a SF stream comprising SF fibers, in accordance with the present disclosure. With reference to FIG. 5, the method may begin at Step 502 in which an average LF fiber length may be measured at one or more locations. In Step 504, the average LF fiber length may be maintained within a target variability range by automatically altering a rotational speed of a rotor of the fiber fractionation system, after which the method may terminate.

Figure 6:
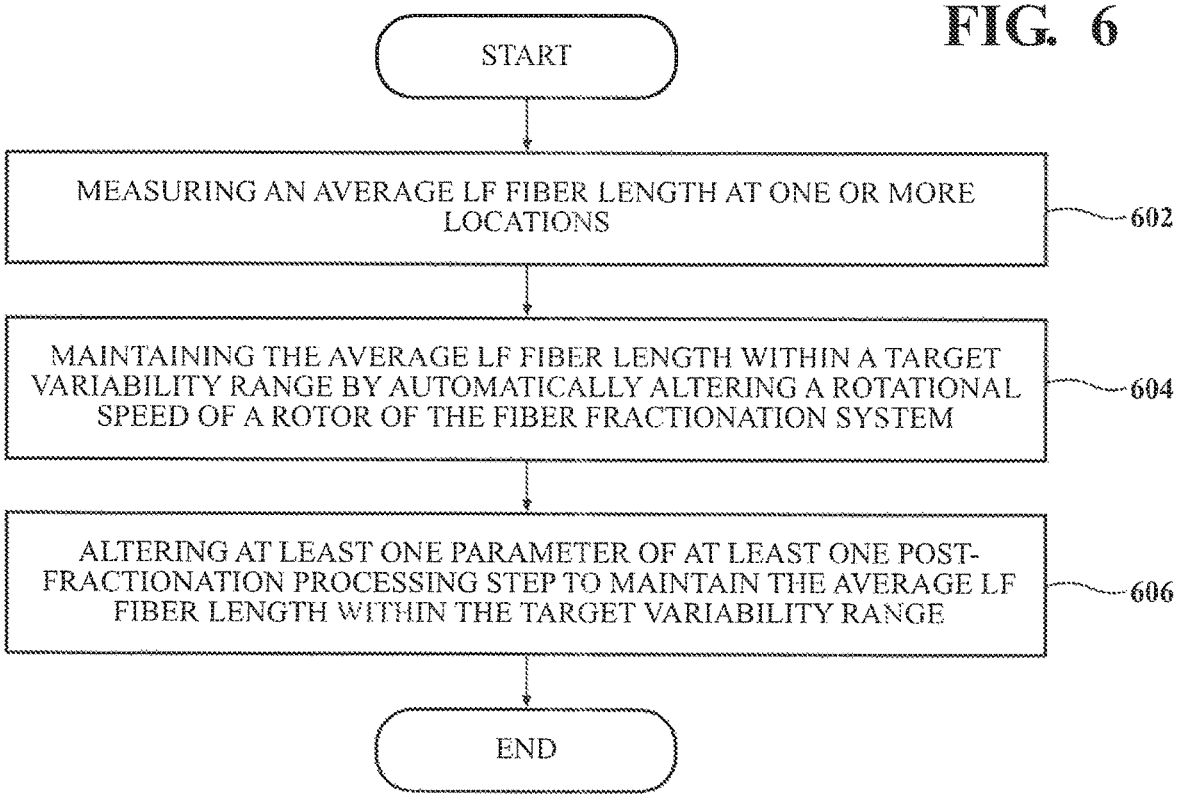
Figure 7:
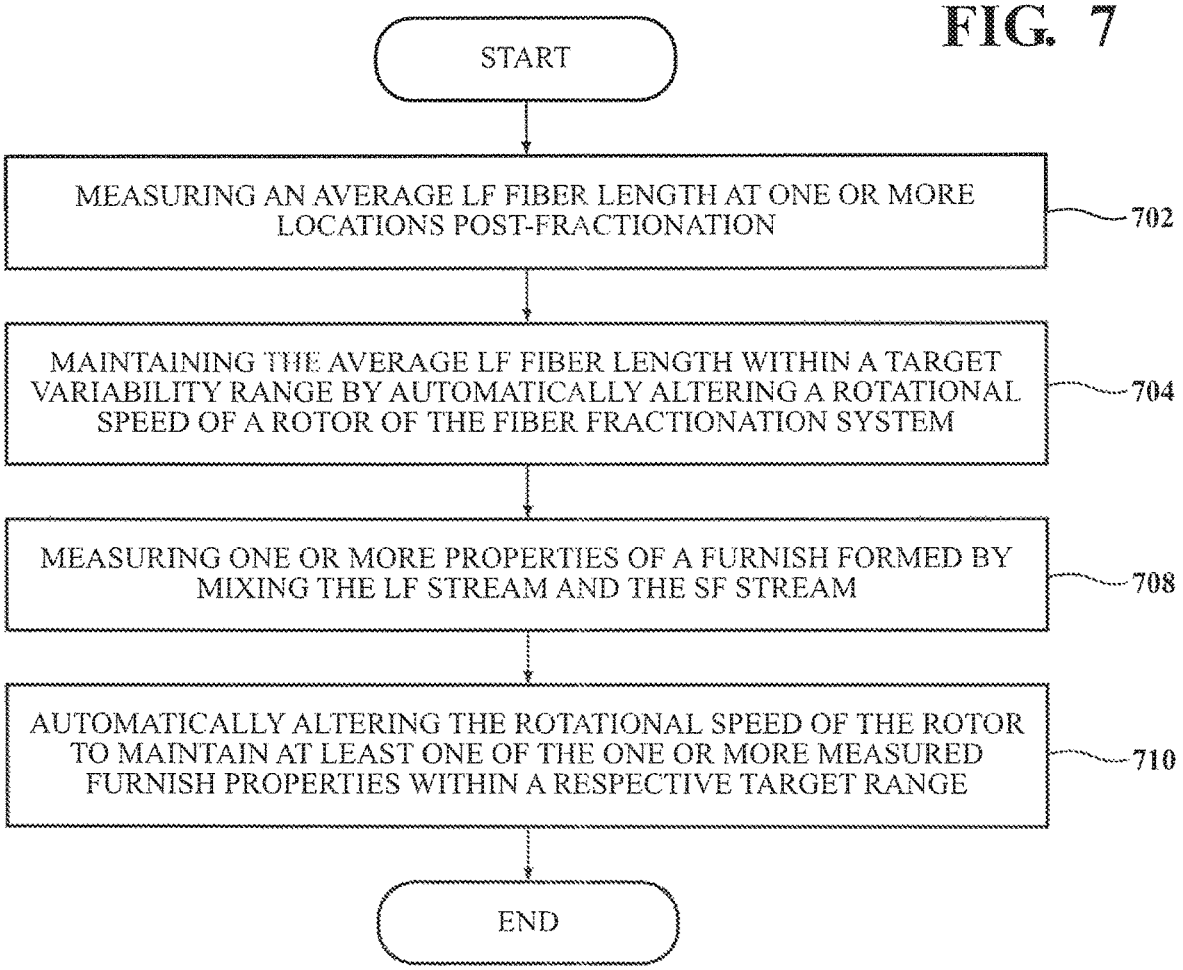
Figure 8:
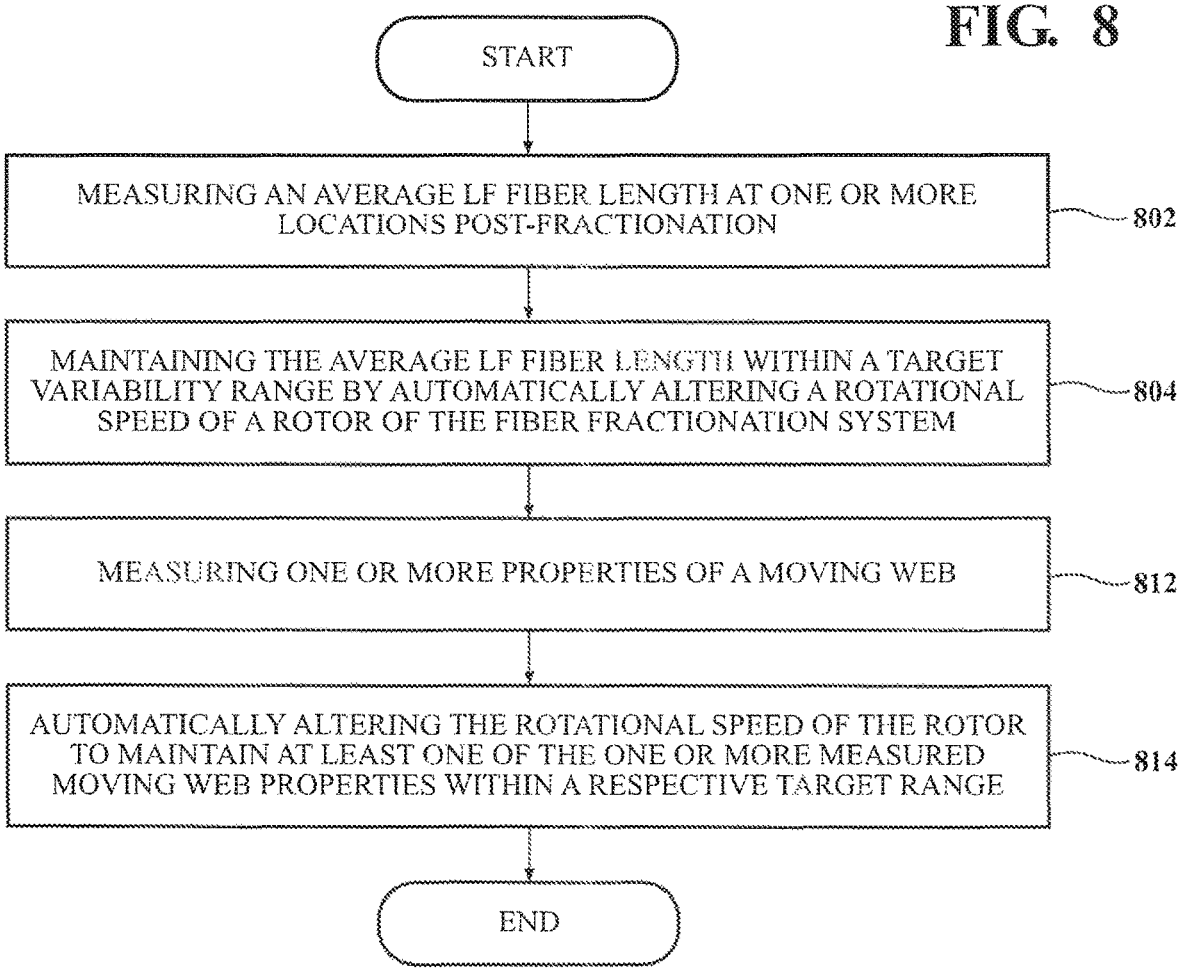
Figure 9:
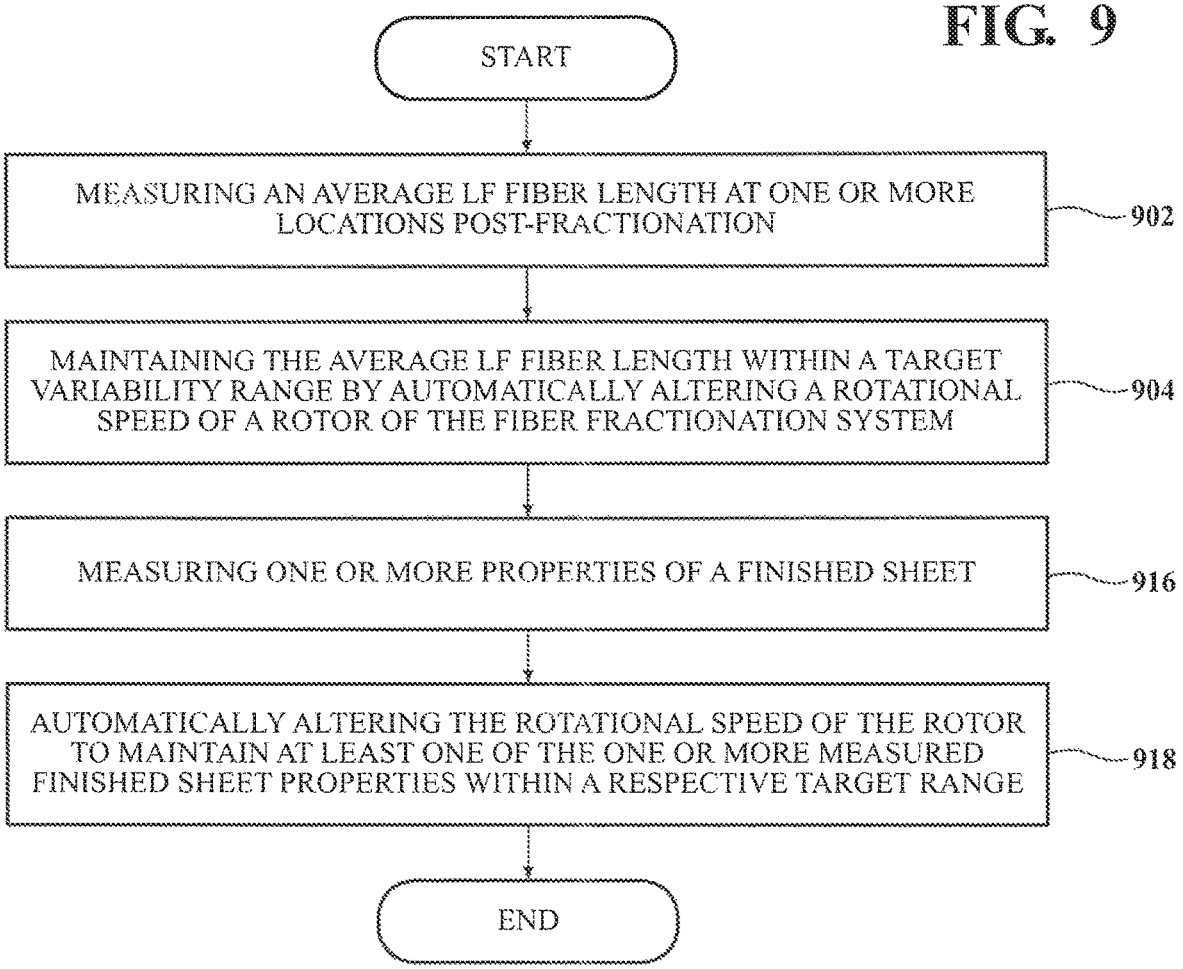
Figure 10:
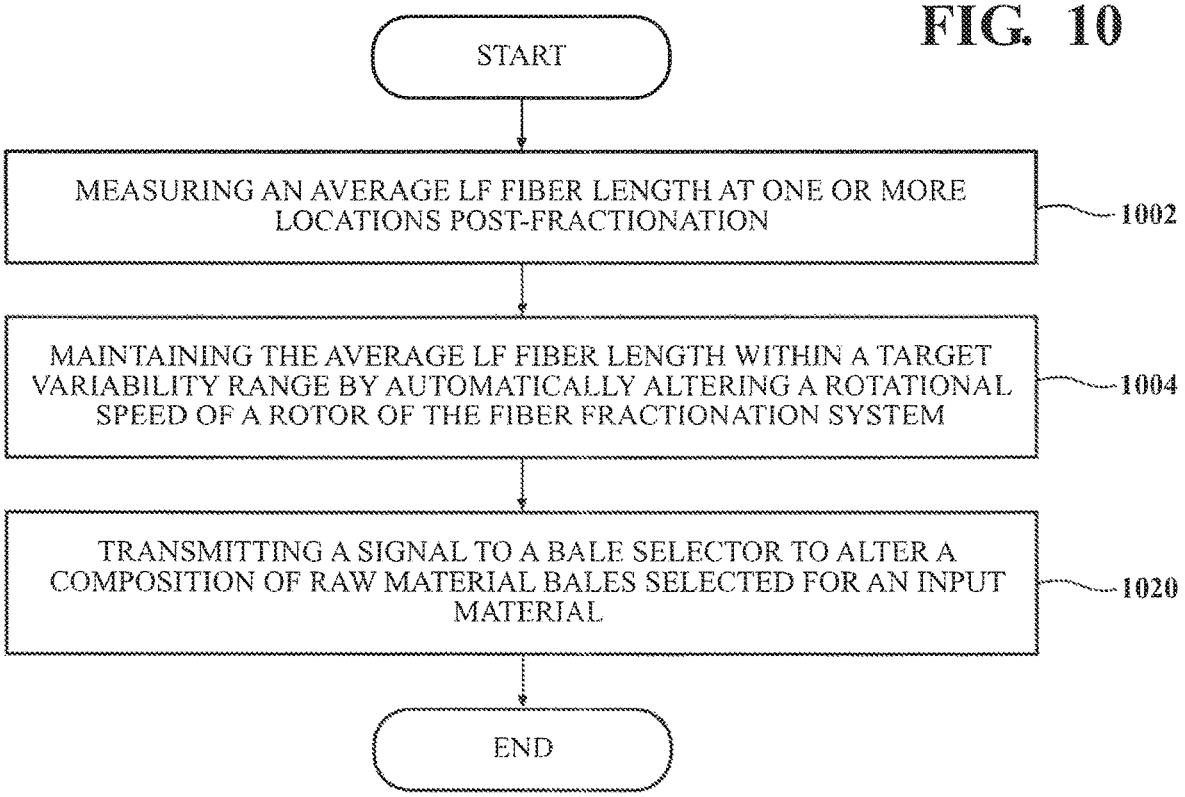
Figure 11:
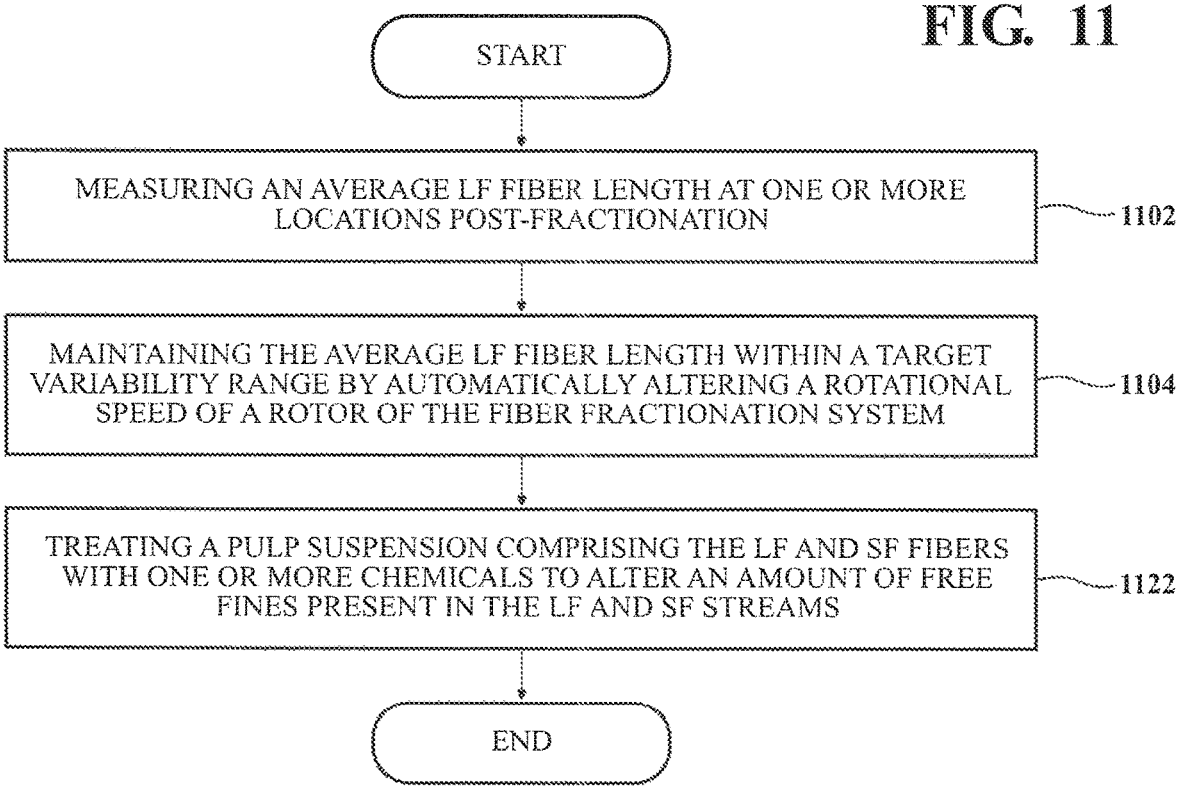
Figure 12:
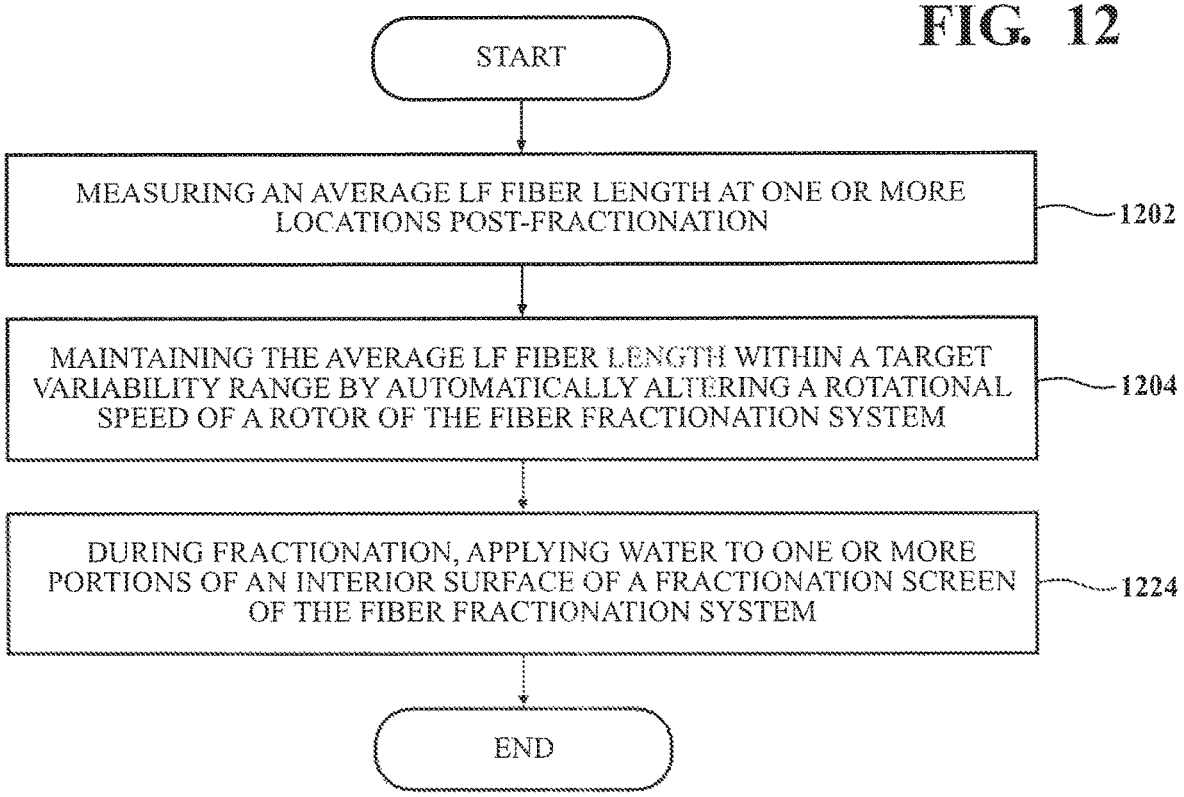

FIGS. 6-12 each illustrate one or more additional, optional steps that may be performed, in which the first two steps are substantially similar to Steps 502 and 504 of FIG. 5. As shown in FIG. 6, the method may further comprise optional Step 606, in which at least one parameter of at least one additional processing step may be altered to maintain the average LF fiber length within the target variability range. As shown in FIG. 7, the method may further comprise optional Step 708, in which one or more properties of a furnish formed by mixing the LF stream and the SF stream may be measured, and optional Step 710, in which at least one of the one or more measured furnish properties may be maintained within a respective target range by automatically altering the rotational speed of the rotor. As shown in FIG. 8, the method may further comprise optional Step 812, in which one or more properties of a moving web may be measured, and optional Step 814, in which at least one of the one or more measured moving web properties may be maintained within a respective target range BY automatically altering the rotational speed of the rotor. As shown in FIG. 9, the method may further comprise optional Step 916, in which one or more properties of a finished sheet may be measured, and optional Step 918, in which at least one of the one or more measured finished properties may be maintained within a respective target range by automatically altering the rotational speed of the rotor. As shown in FIG. 10, the method may further comprise optional Step 1020, in which a signal may be transmitted to a bale selector to alter a composition of raw material bales selected for an input material. As shown in FIG. 11, the method may further comprise optional Step 1122, in which a pulp suspension comprising the LF and SF fibers may be treated with one or more chemicals to alter an amount of free fines present in the LF and SF streams. As shown in FIG. 12, the method may further comprise optional Step 1224, in which, during fractionation, water may be applied to one or more portions of an interior surface of a fractionation screen of the fiber fractionation system.

Figure 13:
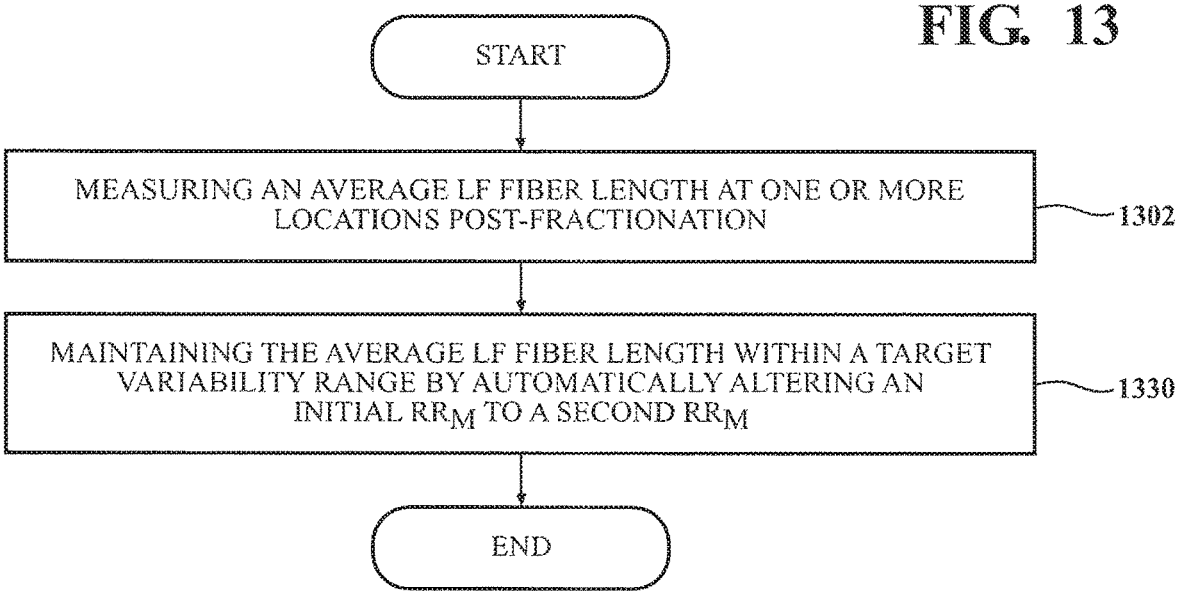
Figure 14:
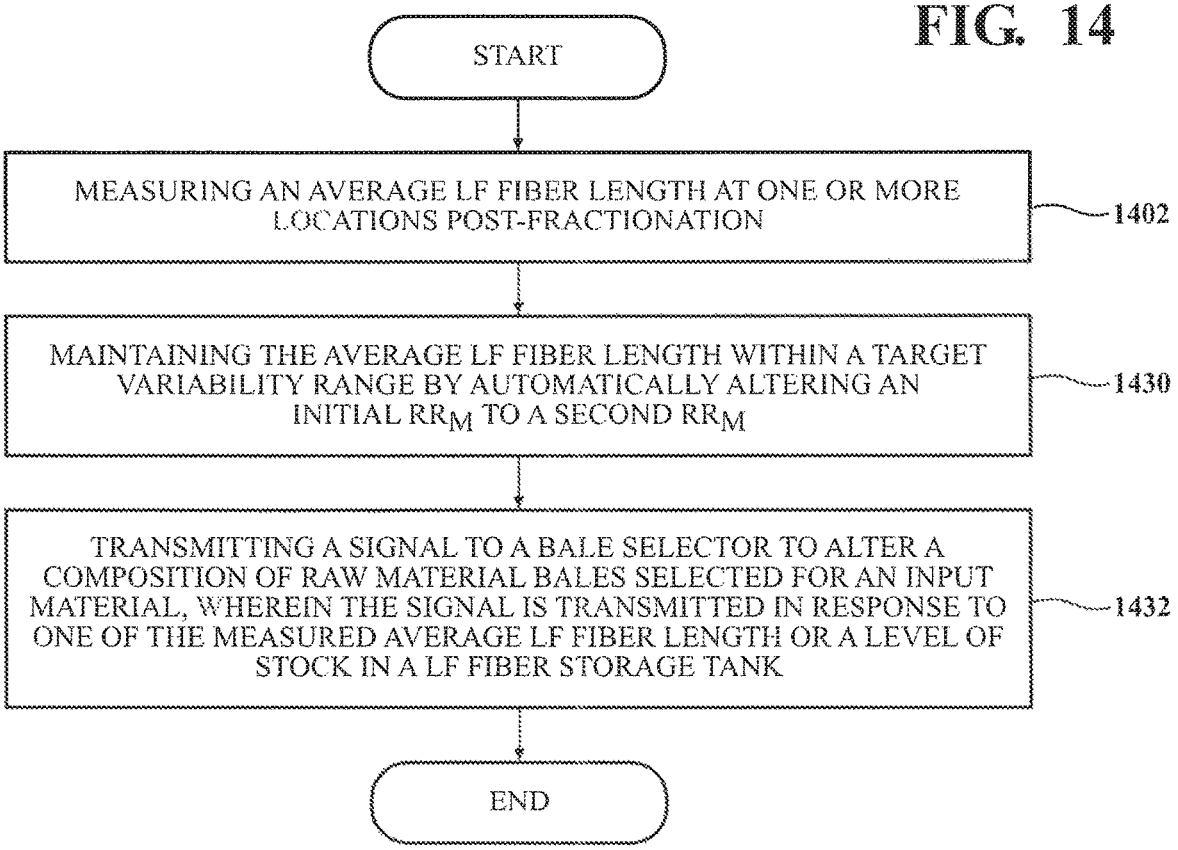

With reference to FIG. 13, a method for controlling a fiber fractionation system, in which the fiber fractionation system comprises an initial mass reject ratio ($RR_m$), is illustrated. The method begins at Step 1302, in which an average LF fiber length may be measured at one or more locations post-fractionation. In Step 1330, the LF average fiber length may be maintained within a target variability range by automatically altering the initial $RR_m$ to a second $RR_m$, after which the method may terminate. FIG. 14 illustrates an additional, optional step that may be performed, in which the first two steps are substantially similar to Steps 1302 and 1330 of FIG. 13. As shown in FIG. 14, the method may further comprise optional Step 1432, in which a signal may be transmitted to a bale selector to alter a composition of raw material bales selected for an input material, in which the signal is transmitted in response to one of the measured average LF fiber length or a level of stock in a LF fiber storage tank.

Figure 15:
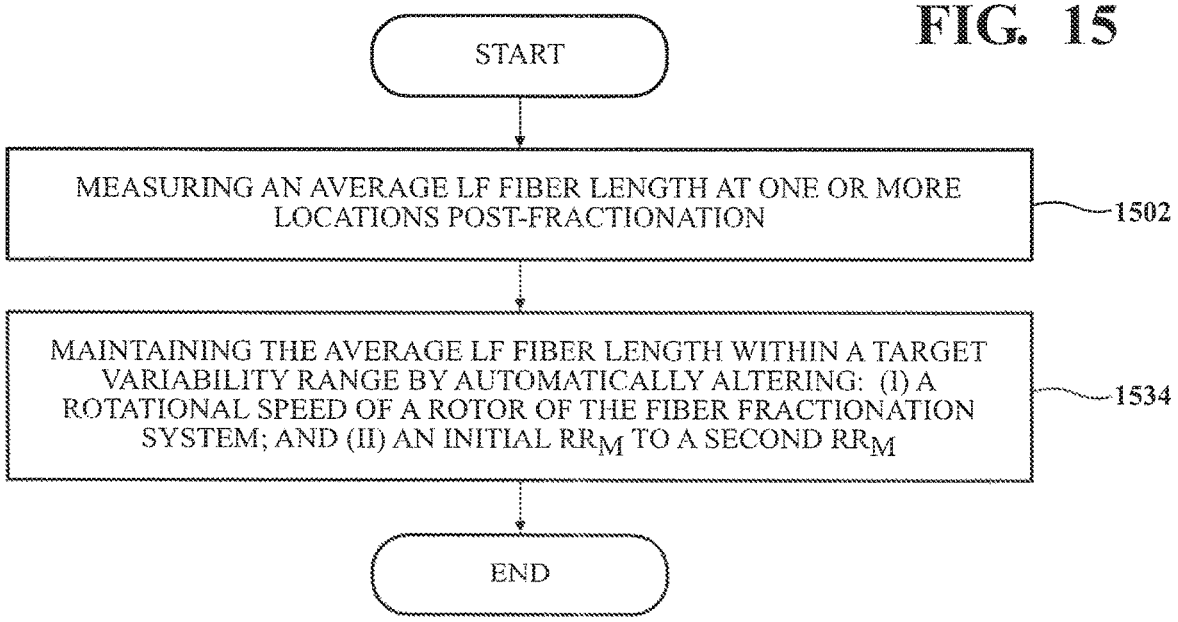

With reference to FIG. 15, a method for controlling a fiber fractionation system, in which the fiber fractionation system comprises an initial mass reject ratio ($RR_m$), is illustrated. The method begins at Step 1502, in which an average LF fiber length may be measured at one or more locations post-fractionation. At Step 1534, the average LF fiber length may be maintained within a target variability range by automatically altering: (i) a rotational speed of a rotor of the fiber fractionation system; and (ii) the initial $RR_m$ to a second $RR_m$, after which the method may terminate.

Figure 16:
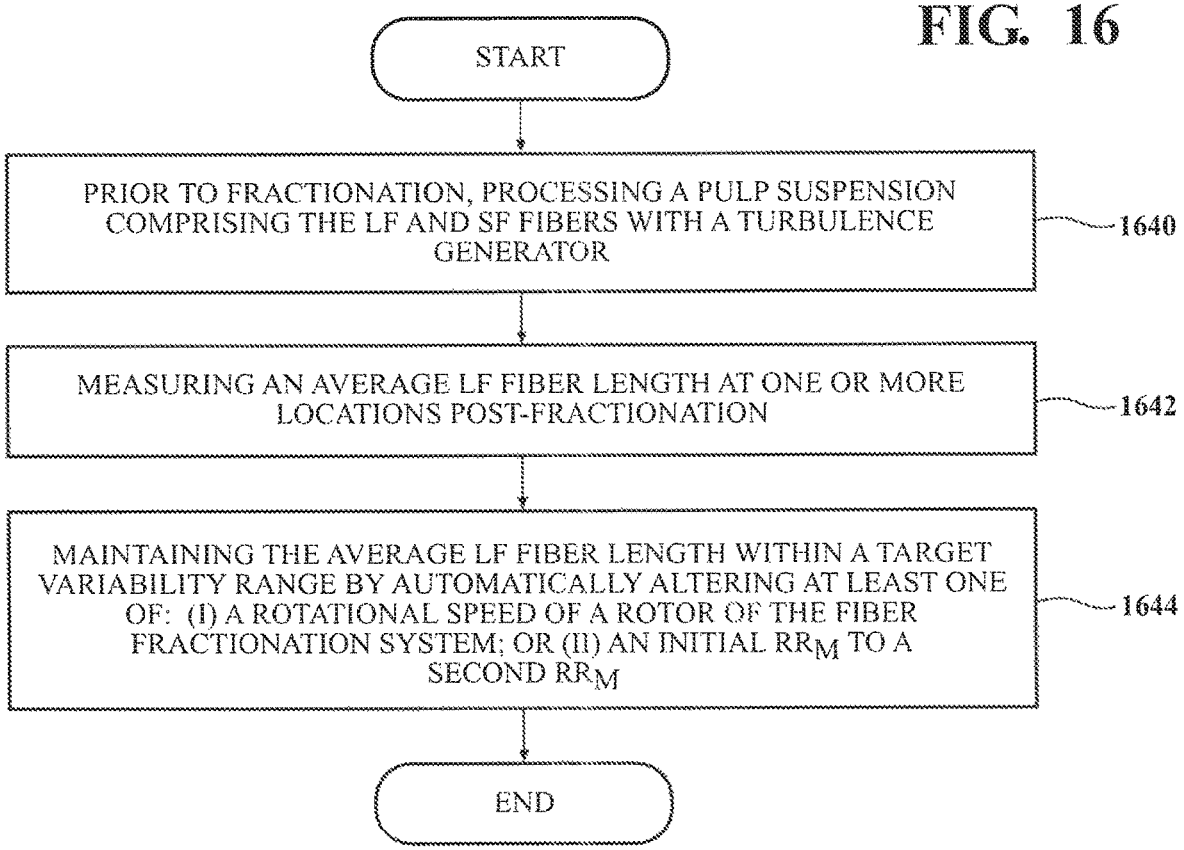

FIG. 16 illustrates a method for controlling a fiber fractionation system, in which the fiber fractionation system comprises an initial mass reject ratio ($RR_m$). The method begins at Step 1640, in which, prior to fractionation, a pulp suspension comprising the LF and SF fibers may be processed with a turbulence generator. At Step 1642, an average LF fiber length may be measured at one or more locations post-fractionation, and at Step 1644, the average LF fiber length may be maintained within a target variability range by automatically altering at least one of: (i) a rotational speed of a rotor of the fiber fractionation system; or (ii) the initial $RR_m$ to a second $RR_m$, after which the method may terminate.

Figure 17:
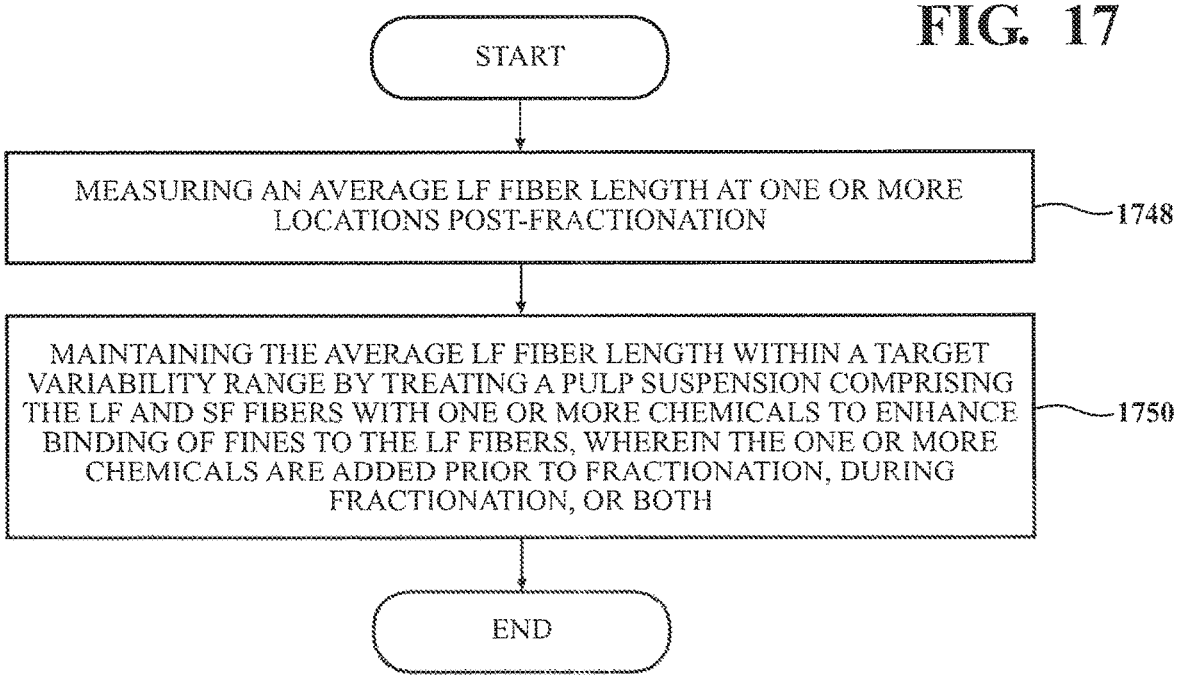
Figure 18:
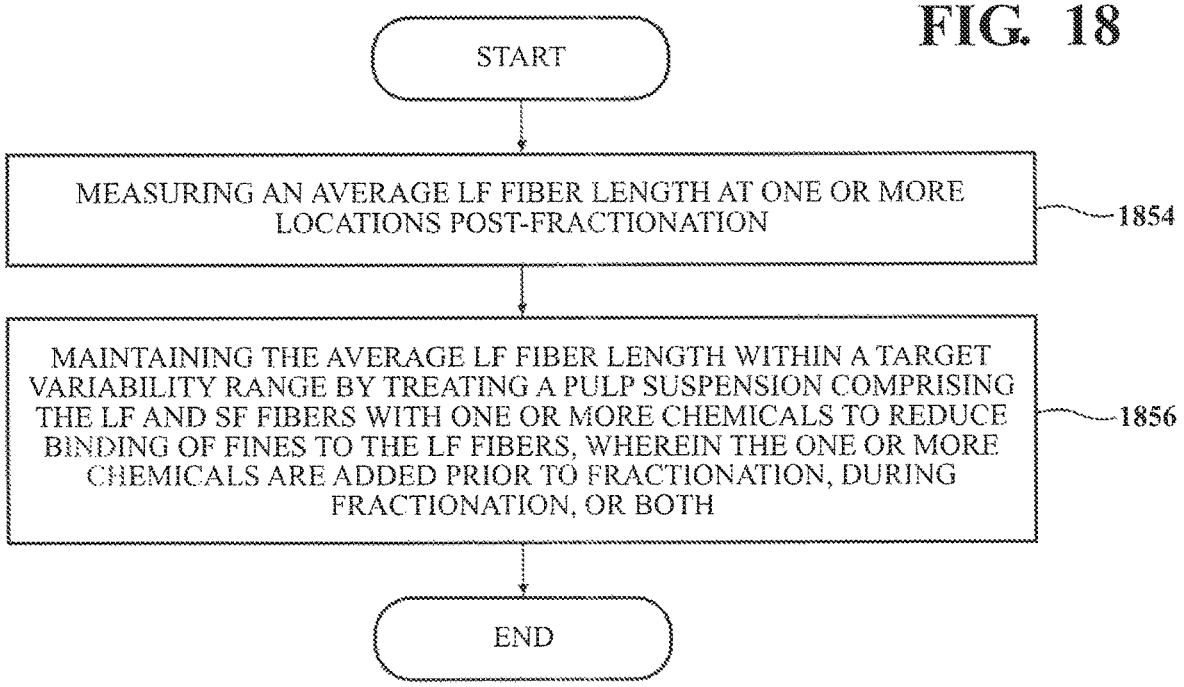
Figure 19:
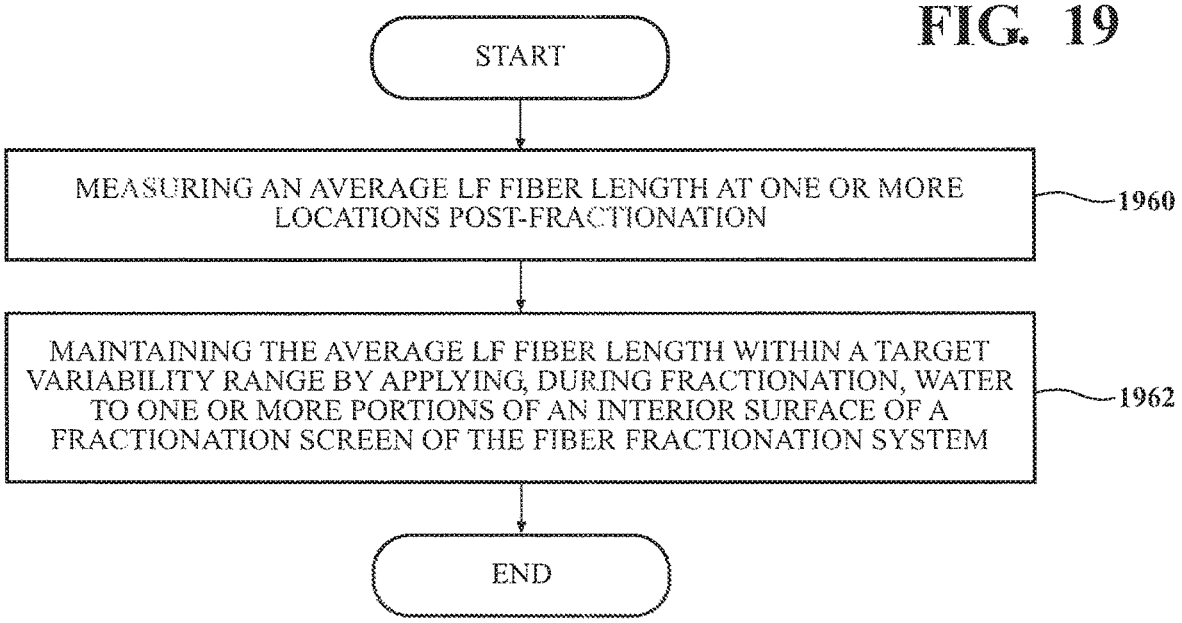

FIGS. 17-19 illustrate methods for controlling a fiber fractionation system based on a quantity of free fines. With reference to FIG. 17, the method begins at Step 1748, in which an average LF fiber length may be measured at one or more locations post-fractionation. At Step 1750, the average LF fiber length may be maintained within a target variability range by treating a pulp suspension comprising the LF and SF fibers with one or more chemicals to enhance binding of fines to the LF fibers, in which the one or more chemicals are added prior to fractionation, during fractionation, or both, after which the method may terminate.

With reference to FIG. 18, the method begins at Step 1854, in which an average LF fiber length may be measured at one or more locations post-fractionation. At Step 1856, the average LF fiber length may be maintained within a target variability range by treating a pulp suspension comprising the LF and SF fibers with one or more chemicals to reduce binding of fines to the LF fibers, wherein the one or more chemicals are added prior to fractionation, during fractionation, or both, after which the method may terminate.

With reference to FIG. 19, the method begins at Step 1960, in which an average LF fiber length may be measured at one or more locations post-fractionation. At Step 1962, the average LF fiber length may be maintained within a target variability range by applying, during fractionation, water to one or more portions of an interior surface of a fractionation screen of the fiber fractionation system, after which the method may terminate.

Figure 20:
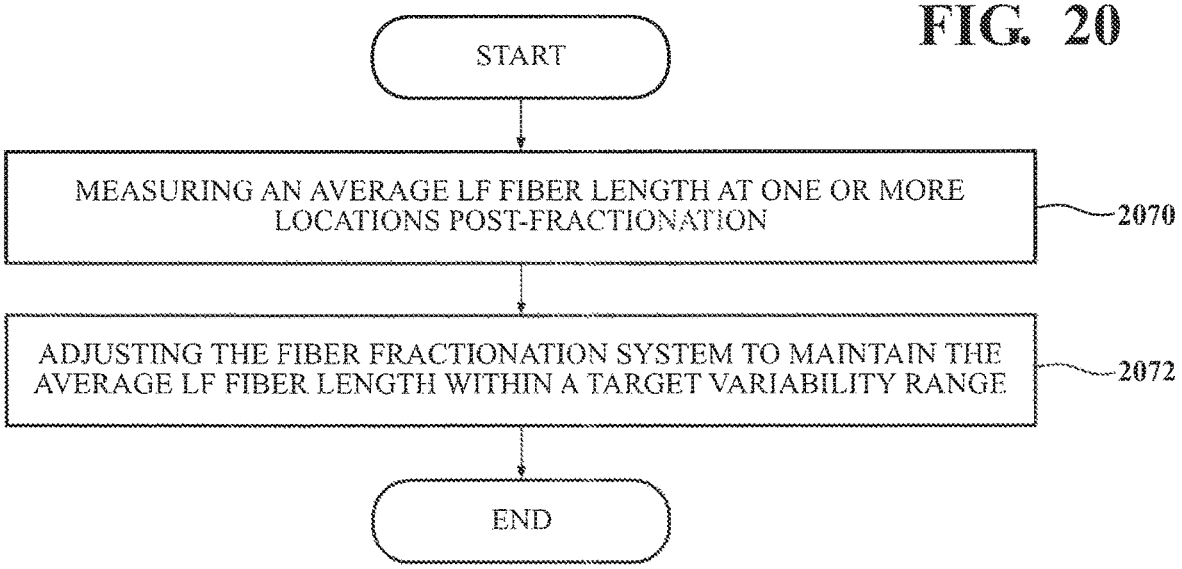

FIG. 20 illustrates a method for controlling a fiber fractionation system for fractionating an input material into a long fraction (LF) stream comprising LF fibers and a short fraction (SF) stream comprising SF fibers. The method begins at Step 2070, in which an average LF fiber length may be measured at one or more locations post-fractionation. At Step 2072, the fiber fractionation system is adjusted to maintain the average LF fiber length within a target variability range, after which the method may terminate.

Figure 21:
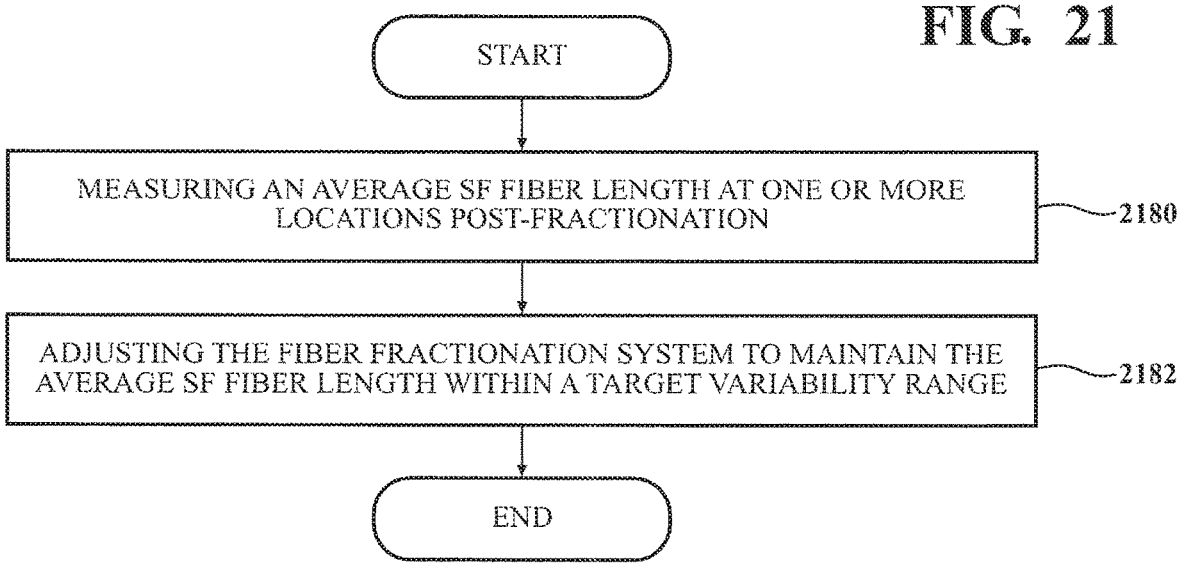

FIG. 21 illustrates a method for controlling a fiber fractionation system for fractionating an input material into a long fraction (LF) stream comprising LF fibers and a short fraction (SF) stream comprising SF fibers. The method begins at Step 2180, in which an average SF fiber length is measured at one or more locations post-fractionation. At Step 2182, the fiber fractionation system is adjusted to maintain the average SF fiber length within a target variability range, after which the method may terminate.

The presently disclosed system and method may be more fully understood by way of the following example.

Prophetic Example

During initialization, the rotational speed of the rotor shaft in the fiber fractionation apparatus is set to 500 RPM. An operator sets an initial target recipe for a grade of a finished product, with a fiber length target for the LF fibers of approximately 1.5 mm (variability range of +/−0.05 mm) and a fiber length target or the SF fibers of approximately 1.0 mm. The mass flow rate for the LF fibers is set to 35% of the total input flow to the fiber fractionation apparatus, and the mass flow rate for the SF fibers is set to 65%. The SF fiber length is not monitored.

The average LF fiber length, as measured by a pulp analyzer just after fractionation, decreases to below the target variability range, e.g., to 1.4 mm. The controller alters one or both of the rotational speed of the rotor shaft or the $RR_m$ to increase the average LF fiber length back to within the target variability range, preferably to the fiber length target of approximately 1.5 mm for the LF fibers. In one example, the controller slightly decreases the rotational speed of the rotor shaft so that the average length of fibers in the stream of LF fibers increases and the average LF fiber length remains substantially constant. In another example, the controller uses one or more control valves to reduce the $RR_m$, which increases the average length of fibers in the stream of LF fibers and keeps the average LF fiber length substantially constant. In a further example, the controller uses a combination of the rotational speed of the rotor shaft and the $RR_m$.

While particular embodiments of the present invention have been illustrated and described, it should be understood that various changes and modifications may be made without departing from the spirit and scope of the invention. It is therefore intended to cover in the appended claims all such changes and modifications that are within the scope of this invention.

What is claimed is:

1. A method for controlling a fiber fractionation system for fractionating an input material into a long fraction (LF) stream comprising LF fibers and a short fraction (SF) stream comprising SF fibers, the method comprising:

measuring an average LF fiber length at one or more locations post-fractionation; and maintaining the average LF fiber length within a target variability range by automatically altering a rotational speed of a rotor of the fiber fractionation system, wherein:

the fiber fractionation system comprises an initial mass reject ratio ($RR_m$); and maintaining the average LF fiber length within the target variability range further comprises automatically altering the initial $RR_m$ to a second $RR_m$.

2. The method of claim 1, wherein the rotational speed of the rotor is controlled by a frequency converter.

3. The method of claim 1, wherein measuring the average LF fiber length is performed immediately after fractionation.

4. The method of claim 1, wherein measuring the average LF fiber length is performed after one or more post-fractionation processing steps.

5. The method of claim 1, further comprising:

altering at least one parameter of at least one post-fractionation processing step to maintain the average LF fiber length within the target variability range.

6. The method of claim 1, further comprising:

measuring one or more properties of a furnish formed by mixing the LF stream and the SF stream; and automatically altering the rotational speed of the rotor of the fiber fractionation system to maintain at least one of the one or more measured furnish properties within a respective target range.

7. The method of claim 6, wherein the one or more measured furnish properties comprise the average LF fiber length, an average SF fiber length, a measured furnish strength, or a predicted furnish strength.

8. The method of claim 1, further comprising:

measuring one or more properties of a moving web; and automatically altering the rotational speed of the rotor of the fiber fractionation system to maintain at least one of the one or more measured moving web properties within a respective target range.

9. The method of claim 8, wherein the one or more measured moving web properties comprise a porosity or a predicted strength property of a finished sheet, the predicted strength property comprising one or more of a short-span compressive strength, a burst strength, or a crush resistance.

10. The method of claim 1, further comprising:

measuring one or more properties of a finished sheet; and automatically altering the rotational speed of the rotor of the fiber fractionation system to maintain at least one of the one or more measured finished sheet properties within a respective target range.

11. The method of claim 10, wherein the one or more measured finished sheet properties comprise a basis weight, a porosity, or a strength property, the strength property comprising one or more of a short-span compressive strength, a burst strength, or a crush resistance.

12. The method of claim 1, further comprising:

transmitting a signal to a bale selector to alter a composition of raw material bales selected for an input material.

13. The method of claim 12, wherein the signal is transmitted to the bale selector in response to one of the measured average LF fiber length or a level of stock in a LF fiber storage tank.

14. The method of claim 1, further comprising:

prior to fractionation, processing a pulp suspension comprising the LF and SF fibers with a turbulence generator.

15. The method of claim 1, further comprising:

treating a pulp suspension comprising the LF and SF fibers with one or more chemicals to alter an amount of free fines present in the LF and SF streams.

16. The method of claim 1, further comprising:

during fractionation, applying water to one or more portions of an interior surface of a fractionation screen of the fiber fractionation system.

17. The method of claim 1, wherein measuring the average LF fiber length is performed in real-time.

18. A method for controlling a fiber fractionation system for fractionating an input material into a long fraction (LF) stream comprising LF fibers and a short fraction (SF) stream comprising SF fibers, wherein the fiber fractionation system comprises an initial mass reject ratio ($RR_m$), the method comprising:

measuring an average LF fiber length at one or more locations post-fractionation; and maintaining the average LF fiber length within a target variability range by automatically altering:

(i) a rotational speed of a rotor of the fiber fractionation system; and (ii) the initial $RR_m$ to a second $RR_m$.

19. The method of claim 18, wherein the rotational speed of the rotor is controlled by a frequency converter.

20. The method of claim 18, wherein measuring the average LF fiber length is performed immediately after fractionation.

21. The method of claim 18, wherein measuring the average LF fiber length is performed after one or more post-fractionation processing steps.

22. The method of claim 18, wherein measuring the average LF fiber length is performed in real-time.

23. A method for controlling a fiber fractionation system for fractionating an input material into a long fraction (LF) stream comprising LF fibers and a short fraction (SF) stream comprising SF fibers, wherein the fiber fractionation system comprises an initial mass reject ratio ($RR_m$), the method comprising:

prior to fractionation, processing a pulp suspension comprising the LF and SF fibers with a turbulence generator;

measuring an average LF fiber length at one or more locations post-fractionation; and maintaining the average LF fiber length within a target variability range by automatically altering at least one of:

(i) a rotational speed of a rotor of the fiber fractionation system; or (ii) the initial $RR_m$ to a second $RR_m$.

24. The method of claim 23, wherein the rotational speed of the rotor is controlled by a frequency converter.

25. The method of claim 23, wherein measuring the average LF fiber length is performed immediately after fractionation.

26. The method of claim 23, wherein measuring the average LF fiber length is performed after one or more post-fractionation processing steps.

27. The method of claim 23, wherein measuring the average LF fiber length is performed in real-time.

28. A method for controlling a fiber fractionation system for fractionating an input material into a long fraction (LF) stream comprising LF fibers and a short fraction (SF) stream comprising SF fibers, the method comprising:

measuring an average LF fiber length at one or more locations post-fractionation; and maintaining the average LF fiber length within a target variability range by treating a pulp suspension comprising the LF and SF fibers with one or more chemicals to enhance binding of fines to the LF fibers, wherein the one or more chemicals are added prior to fractionation, during fractionation, or both, wherein the fiber fractionation system comprises an initial mass reject ratio ($RR_m$) and wherein maintaining the average LF fiber length within the target variability range further comprises one or more of:

automatically altering at least one of:

(i) a rotational speed of a rotor of the fiber fractionation system; or (ii) the initial $RR_m$ to a second $RR_m$; or applying, during fractionation, water to one or more portions of an interior surface of a fractionation screen of the fiber fractionation system.

29. The method of claim 28, wherein the rotational speed of the rotor is controlled by a frequency converter.

30. The method of claim 28, wherein measuring the average LF fiber length is performed immediately after fractionation.

31. The method of claim 28, wherein measuring the average LF fiber length is performed after one or more post-fractionation processing steps.

32. The method of claim 28, wherein measuring the average LF fiber length is performed in real-time.

33. A method for controlling a fiber fractionation system for fractionating an input material into a long fraction (LF) stream comprising LF fibers and a short fraction (SF) stream comprising SF fibers, the method comprising:

measuring an average LF fiber length at one or more locations post-fractionation; and maintaining the average LF fiber length within a target variability range by treating a pulp suspension comprising the LF and SF fibers with one or more chemicals to reduce binding of fines to the LF fibers, wherein the one or more chemicals are added prior to fractionation, during fractionation, or both, wherein the fiber fractionation system comprises an initial mass reject ratio ($RR_m$) and wherein maintaining the average LF fiber length within the target variability range further comprises one or more of:

automatically altering at least one of:

(i) a rotational speed of a rotor of the fiber fractionation system; or (ii) the initial $RR_m$ to a second $RR_m$; or applying, during fractionation, water to one or more portions of an interior surface of a fractionation screen of the fiber fractionation system.

34. The method of claim 33, wherein the rotational speed of the rotor is controlled by a frequency converter.

35. The method of claim 33, wherein measuring the average LF fiber length is performed immediately after fractionation.

36. The method of claim 33, wherein measuring the average LF fiber length is performed after one or more post-fractionation processing steps.

37. The method of claim 33, wherein measuring the average LF fiber length is performed in real-time.

38. A method for controlling a fiber fractionation system for fractionating an input material into a long fraction (LF) stream comprising LF fibers and a short fraction (SF) stream comprising SF fibers, the method comprising:

measuring an average LF fiber length at one or more locations post-fractionation; and maintaining the average LF fiber length within a target variability range by applying, during fractionation, water to one or more portions of an interior surface of a fractionation screen of the fiber fractionation system, wherein the fiber fractionation system comprises an initial mass reject ratio ($RR_m$) and wherein maintaining the average LF fiber length within the target variability range further comprises one or more of:

automatically altering at least one of:

(i) a rotational speed of a rotor of the fiber fractionation system; or (ii) the initial $RR_m$ to a second $RR_m$;

treating a pulp suspension comprising the LF and SF fibers with one or more chemicals to enhance binding of fines to the LF fibers; or treating the pulp suspension comprising the LF and SF fibers with one or more chemicals to reduce binding of fines to the LF fibers, wherein the one or more chemicals are added prior to fractionation, during fractionation, or both.

39. The method of claim 38, wherein the rotational speed of the rotor is controlled by a frequency converter.

40. The method of claim 38, wherein measuring the average LF fiber length is performed immediately after fractionation.

41. The method of claim 38, wherein measuring the average LF fiber length is performed after one or more post-fractionation processing steps.

42. The method of claim 38, wherein measuring the average LF fiber length is performed in real-time.

43. The method of claim 38, wherein applying water to one or more portions of the interior surface of a fractionation screen comprises spraying, via a forming shower, adjustable pressure water.

44. A method for controlling a fiber fractionation system for fractionating an input material into a long fraction (LF) stream comprising LF fibers and a short fraction (SF) stream comprising SF fibers, the method comprising:

measuring an average SF fiber length at one or more locations post-fractionation; and maintaining the average SF fiber length within a target variability range by automatically altering a rotational speed of a rotor of the fiber fractionation system, wherein:

the fiber fractionation system comprises an initial mass reject ratio ($RR_m$); and maintaining the average SF fiber length within the target variability range further comprises automatically altering the initial $RR_m$ to a second $RR_m$.

45. The method of claim 44, wherein maintaining the average SF fiber length within the target variability range further comprises treating a pulp suspension comprising the LF and SF fibers with one or more chemicals to enhance binding of fines to the LF fibers, wherein the one or more chemicals are added prior to fractionation, during fractionation, or both.

46. The method of claim 44, wherein maintaining the average SF fiber length within the target variability range further comprises treating a pulp suspension comprising the LF and SF fibers with one or more chemicals to reduce binding of fines to the LF fibers, wherein the one or more chemicals are added prior to fractionation, during fractionation, or both.

47. The method of claim 44, wherein maintaining the average SF fiber length within the target variability range further comprises applying, during fractionation, water to one or more portions of an interior surface of a fractionation screen of the fiber fractionation system.

* * * * *